US006431674B2

(12) United States Patent
Suzuki et al.

(10) Patent No.: US 6,431,674 B2
(45) **Date of Patent: *Aug. 13, 2002**

(54) INK-JET RECORDING HEAD THAT MINUTELY VIBRATES INK MENISCUS

(75) Inventors: Kazunaga Suzuki; Kenji Tsukada; Yoshiyuki Koike; Takeo Seino; Yasuhiro Ouki; Yasuhiko Kosugi; Toshihisa Saruta; Hidetaka Sakurai, all of Nagano (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/791,765

(22) Filed: Jan. 29, 1997

(30) Foreign Application Priority Data

| | | |
|---|---|---|
| Jan. 29, 1996 | (JP) | 8-034337 |
| Feb. 22, 1996 | (JP) | 8-035250 |
| Jun. 20, 1996 | (JP) | 8-180107 |
| Oct. 21, 1996 | (JP) | 8-297838 |

(51) Int. Cl.[7] ..... B41J 2/045
(52) U.S. Cl. ..... 347/10; 347/11
(58) Field of Search ..... 347/10, 11, 27, 347/68, 70

(56) References Cited

U.S. PATENT DOCUMENTS

| | | | | |
|---|---|---|---|---|
| 4,350,989 A | | 9/1982 | Sagae et al. | 347/9 |
| 4,609,925 A | * | 9/1986 | Nozu et al. | 347/27 |
| 5,264,865 A | * | 11/1993 | Shimoda et al. | 347/11 |
| 5,329,293 A | | 7/1994 | Liker | 347/11 |
| 5,541,628 A | * | 7/1996 | Chang et al. | 347/10 |
| 5,790,139 A | * | 8/1998 | Umeno et al. | 347/10 |
| 5,818,472 A | * | 10/1998 | Usui et al. | 347/10 |

FOREIGN PATENT DOCUMENTS

| | | | |
|---|---|---|---|
| EP | 0020984 | 1/1981 | B41J/3/04 |
| EP | 0574016 | 12/1993 | B41J/2/015 |
| EP | 0782924 | 7/1997 | B41J/2/045 |
| JP | 57-61576 | 4/1982 | |

* cited by examiner

*Primary Examiner*—Craig H. Hallacher
(74) *Attorney, Agent, or Firm*—Sughrue Mion, PLLC

(57) ABSTRACT

An ink-jet recording apparatus having an ink-jet recording head including pressure generating chambers communicatively connected to a nozzle opening and a reservoir, pressure generating member for pressurizing the pressure generating chambers, and a control device for applying drive signals to the pressure generating member. The control device applies drive signals to the pressure generating member. The drive signals contain signals corresponding to print data and signals which minutely vibrate the meniscus of ink in the nozzle openings to such an extent as to not eject ink droplets during a nonprint period. The control device causes ejection of ink droplets from the nozzle openings in accordance with print data during printing operations, and minutely vibrates the meniscuses of ink formed at the nozzle openings a preset period of time before or after the discharging of the ink droplets in a printing operation.

41 Claims, 21 Drawing Sheets

INK-JET RECORDING HEAD THAT MINUTELY VIBRATES INK MENISCUS

BACKGROUND OF THE INVENTION

The present invention relates to an ink-jet recording apparatus having a recording head which ejects ink droplets through nozzles by varying the amount of pressure in a pressure generating chamber, which is communicatively connected to the nozzle opening and a reservoir of ink, in accordance with print data. More particularly, the invention relates to a technique for preventing the nozzle openings from being clogged.

An ink-jet recording head of the on-demand type includes many nozzle openings and pressure generating chambers associated with the nozzle openings. The pressure generating chambers expand and contract in accordance with print signals, to eject ink droplets through the nozzle openings. In the recording head, fresh ink is successively supplied to selected nozzle openings for carrying out a printing operation. Accordingly, there is little chance that those nozzle openings will become clogged. On the other hand, the nozzle openings that are infrequently used to eject ink droplets, such as those orifices located at upper and lower ends of the recording head, frequently clog. This is a problem.

To overcome this problem, after the printing operation is continued for a predetermined period of time, a flushing operation is performed in which the recording head is returned to the capping means in a nonprint area, and a drive signal is applied to the piezoelectric transducers, to eject ink droplets forcibly through all of the nozzle openings toward the cap.

In performing the flushing operation, the printing operation is interrupted, thereby decreasing the printing speed, and consuming a relatively large amount of ink. To solve these problems, many techniques have been proposed. According to one technique, a drive signal having an amplitude as not to eject ink droplets is applied to the piezoelectric transducers provided in the pressure generating chambers communicatively connected to the nozzle openings which eject no ink droplets during the printing operation. By the application of such a drive signal, the meniscuses present near the orifices are minutely vibrated, to thereby prevent the orifices from being clogged (See, for example, Japanese Patent Laid-Open Publication Nos. Sho. 55-123476 and 57-61576, and U.S. Pat. No. 4,350,467 989).

In this connection, a proposal has been made for a bubble jet recording head, in which the pressure applied to eject ink droplets depends on the evaporation of ink. According to this proposal, a piezoelectric transducer is attached to the reservoir, wherein the ink pressure is varied by the transducer. A varied pressure is transmitted through the ink supply port to the pressure generating chamber, to thereby minutely vibrate a meniscus formed at the nozzle opening.

Thus, by minutely vibrating the meniscuses at fixed time intervals, the number of flushing operations is reduced, thereby preventing the decrease of the printing speed and the increase of the ink consumption. Moreover, this method substantially eliminates the possibility that the nozzle openings will become clogged. However, by vibrating the meniscuses even minutely adversely affects the discharging operation of ink droplets when forming dots in a print operation. This deteriorates the print quality and is thus a problem. Moreover, the audible sound caused by the minute vibration of the meniscuses is noisy, because the number of piezoelectric transducers being driven is considerably larger than the number for discharging ink droplets. Because of this, the lifetime of the piezoelectric transducers is reduced and hence the lifetime of the recording head is also reduced.

Where the type of ink used is suitable for printing very small dots and likely to form a film, the minute vibration of the meniscuses (for the purpose of preventing the nozzle openings from clogging) promotes the volatilization of the ink solvent in the nozzle openings which are not used for printing in a printing operation, and helps the progress of the clogging of the nozzle openings. Since the viscosity of the ink depends largely on temperature, if the ambient temperature rises the ink viscosity decreases, and the minute vibration excessively moves the meniscus, so that ink wets the nozzle plate. The result is to deviate the flying path of the ink droplet when it ejects for printing.

SUMMARY OF THE INVENTION

Accordingly, a first object of the present invention is to provide an ink-jet recording apparatus which can prevent the nozzle openings from being clogged, and maintain very high print quality even with residual vibration of the minute vibration of the meniscuses.

A second object of the present invention is to provide an ink-jet recording apparatus which can reliably eliminate the clogging of the nozzle openings by reducing the frequency of vibrations of the piezoelectric transducer.

A third object of the present invention is to provide an ink-jet recording apparatus which can maximize the time until the nozzle opening becomes clogged, independently of a variation of the ambient temperature and without deviating the flying path of the ejecting ink droplet.

According to the above and other objects of the present invention, there is provided an ink-jet recording apparatus having an ink-jet recording head including pressure generating chambers each communicatively connected to a nozzle opening and a reservoir, pressure generating means for pressurizing the pressure generating chambers, and control means for applying drive signals corresponding to print data to the recording head and for minutely vibrating the meniscuses in the nozzle openings to such an extent as to not eject ink droplets during a nonprint period. The improvement is characterized in that the control means eject ink droplets from the nozzle openings in accordance with print data every print cycle during a print period, and minutely vibrates the meniscuses a preset period of time before the discharging of the ink droplets or a preset period of time after the discharging of the ink droplets.

DESCRIPTION OF THE PREFERRED EMBODIMENT

Figure 1:
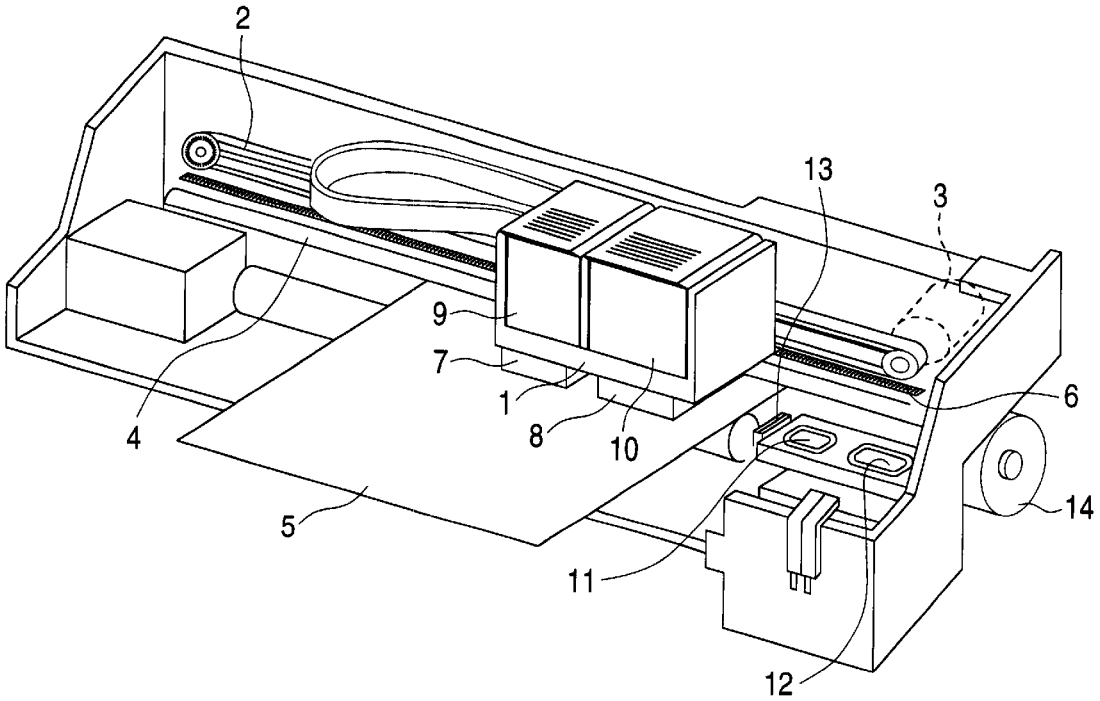
FIG. 1 is a perspective view showing an embodiment of a printing mechanism of an ink-jet recording apparatus according to the present invention.

FIG. 1 shows a structure of a printing mechanism and related components in a printer which is a type of an ink-jet recording apparatus according to the present invention. Referring to FIG. 1, reference numeral 1 designates a carriage connected to a carriage drive motor 3 through a timing belt 2. The carriage 1 is reciprocatively moved in the width-wise direction of a recording sheet 5, while being guided by the guide member 4. The position of the moving carriage is detected by a linear encoder 6. Ink-jet recording heads 7 and 8 are firmly attached to the side of the carriage 1 which faces the recording sheet 5, or the lower side thereof. With the movement of the carriage 1, the recording heads 7 and 8, which receive ink from ink cartridges 9 and 10 mounted on the carriage 1, eject ink droplets toward the recording sheet 5 to form dots thereon by which characters and pictures are formed. Cap members 11 and 12, provided in a nonprint region, tightly cover the nozzle openings of the recording heads 7 and 8 when the recording heads are at rest, and receive ink ejecting from the recording heads 7 and 8 in the flushing operation during a printing operation. Reference numeral 13 designates cleaning means having, for example, a rubber plate for wiping the nozzle openings of the recording heads 7 and 8 clean. Numeral 14 indicates a paper feed motor.

Figure 2:
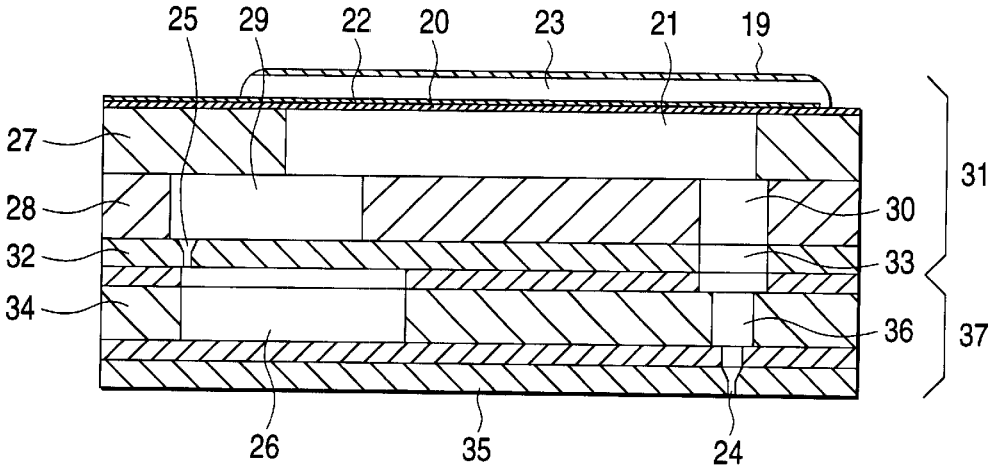
FIG. 2 is a sectional view showing an ink-jet recording head used in the ink-jet recording apparatus of FIG. 1.

FIG. 2 shows an example of each of the recording heads 7 and 8. Reference numeral 20 designates a first cover member, which is constituted by a zirconia thin plate of about 10 $\mu$m thick. A drive electrode 22 is formed on one of the major surfaces of the first cover member 20, while facing a pressure generating chamber 21. A piezoelectric transducer 23 made of PZT, for example, is formed on the surface of the drive electrode 22, and an electrode 19 is formed on the piezoelectric transducer 23. The pressure generating chamber 21 receives a flexural vibration of the piezoelectric transducer 23, so that the chambers are expanded and contracted to eject ink droplets from a nozzle opening 24, and receives ink from a reservoir 26 through an ink supply port 25. A spacer 27 is a bored, ceramic plate made of zirconia ($ZrO_2$) or the like and having a thickness of 150 $\mu$m, for example, suitable for forming the pressure generating chamber 21. One side of the spacer 27 is sealed with a second cover member 28, whereas the other side of spacer 27 is sealed with the first cover member 20, where the pressure generating chamber 21 is formed. The second cover member 28 is also a ceramic plate made of zirconia, for example, having connecting holes 29, each communicating with an ink supply port 25 and a pressure generating chamber 21, and connecting holes 30, each communicatively connecting a pressure generating chamber 21 and a nozzle opening 24. The second cover member 28 is firmly attached to the other major side of the spacer 27. These members 20, 27 and 28 are assembled into an actuator unit 31 without using adhesive, in such a manner that granular ceramic material is properly shaped into thin plates which are layered and sintered.

An ink-supply-port forming plate 32 serves as a fixing plate for fixing the actuator unit 31. The plate 32 is made of a metal of ink resistance, such as stainless steel or ceramic, so as to serve as a connecting member to the ink cartridges 9 and 10. The ink-supply-port forming plate 32 has the ink supply ports 25 each formed at a location close to one end of the pressure generating chamber 21. The ink supply port 25 connects the reservoir 26 to the pressure generating chamber 21. Further, the port 25 has connecting holes 33 each formed at a location close to the other end of the pressure generating chamber 21. The connecting hole 33 communicatively connects the nozzle opening 24 and a connecting hole 30 of the actuator unit 31.

A reservoir-forming plate 34 is a plate-like member which is made of a corrosion resistance material such as, for example, stainless steel, and has a thickness suitable for forming the reservoir 26, for example, of 150 $\mu$m. A through-hole corresponding to the shape of the reservoir 26 and a connecting hole 36 for communicatively connecting the nozzle opening 24 of the nozzle plate 35 and the connecting hole 30 are formed in the reservoir-forming plate 34. The ink-supply-port forming plate 32, the reservoir-forming plate 34 and the nozzle plate 35 are bonded together into a fluid passage unit 37, by hot-melt films or adhesion inserted therebetween. The actuator unit 31 is bonded onto the surface of the ink-supply-port forming plate 32 of the fluid passage unit 37 by adhesive, to thereby form an ink-jet recording head 7.

In operation, a drive signal is applied to the thus constructed recording head while controlling the carriage 1 in accordance with a position signal derived from the linear encoder 6. Then, the piezoelectric transducer 23 is charged, and is flexurally displaced to contract the pressure generating chamber 21. The chamber 21 compresses ink therein and an ink droplet ejects through the nozzle opening 24. After a preset time elapses, the piezoelectric transducer 23 is discharged, and the piezoelectric transducer 23 returns to its original state. The pressure generating chamber 21 is now expanded. In turn, ink flows from the reservoir 26 to the pressure generating chamber 21 through the ink supply port 25. As a result, ink is supplied to the pressure generating chamber 21 for the next printing operation.

A voltage which is too small to cause ink to eject is applied to the piezoelectric transducer 23. In turn, a minute flexural displacement is caused in the piezoelectric transducer 23, and the pressure generating chamber 21 is minutely contracted. A meniscus present near the nozzle opening 24 is then pushed up a small distance toward the nozzle opening 24. Thereafter, the piezoelectric transducer 23 is discharged, so that it returns to its original state, and the pressure generating chamber 21 is minutely expanded. The meniscus descends toward the pressure generating chamber 21 from the nozzle opening side. If the piezoelectric transducer 23 is minutely bent and restored from its bent state in synchronism with the printing operation, the meniscus present near the nozzle opening minutely vibrates. As a result, old ink staying near the nozzle opening is replaced with fresh ink, thereby eliminating the clogging of the nozzle opening.

Figure 3:
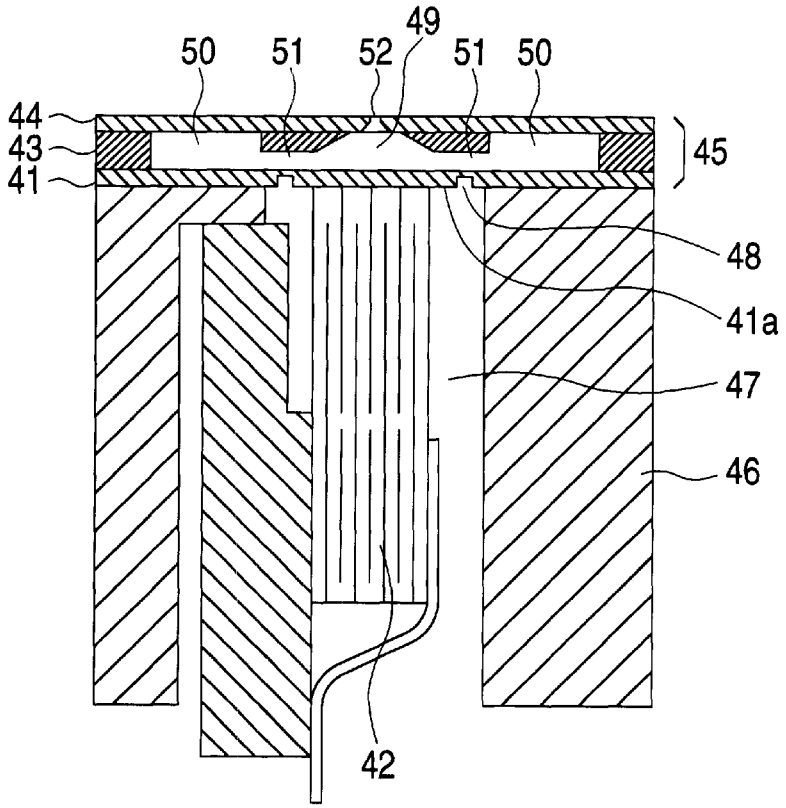
FIG. 3 is a sectional view showing still another ink-jet recording head that may be used in the ink-jet recording apparatus.

The above-described recording head uses a piezoelectric transducer that flexurally vibrates. The ink-jet recording head 7 of which the pressure generating means may also be a piezoelectric transducer which is axially displaced, or which is of the longitudinal oscillation mode type, as shown in FIG. 3. To be more specific, an elastic plate 41 is a thin plate which is elastically deformed in contact with the end of a piezoelectric transducer 42. The elastic plate 41, a passage-forming plate 43 and a nozzle plate 44 are assembled to be liquid-tight, while the plate 43 is sandwiched in between the plates 41 and 42, into a fluid passage unit 45. A base member 46 includes a transducer accommodating chamber 47 which supports a piezoelectric transducer 42 allowing the transducer to vibrate, and has a surface with an opening 48 for supporting a fluid passage unit 45. The fluid passage unit 45 is fastened to the surface of the base plate 46 such that the end of the piezoelectric transducer 42 is brought into contact with an island 41*a* of the elastic plate 41.

In the thus constructed recording head, when the piezoelectric transducer 42 is charged, it contracts and the pressure generating chamber 49 of the passage-forming plate 43 is expanded. In turn, ink flows from the reservoirs 50 into the pressure generating chamber 49, through the ink supply ports 51. After a preset time elapses, the piezoelectric transducer 42 is discharged and the piezoelectric transducer 42 resumes its original state. Then, the pressure generating chamber 49 is contracted to compress ink therein and to eject an ink droplet through a nozzle opening 52 toward the recording sheet. The ink droplet forms a dot on the recording sheet.

A pulse signal that is too small to cause ink to eject is applied to the piezoelectric transducer 42. The piezoelectric transducer 42 minutely contracts. The pressure generating chamber 49 is minutely expanded. Accordingly, a meniscus present near the nozzle opening 52 descends to the pressure generating chamber 49. Then, the piezoelectric transducer 42 is caused to resume its original state. The pressure generating chamber 49 is contracted to move the meniscus toward the nozzle opening 52.

If the piezoelectric transducer 42 is caused to minutely expand and contract in synchronism with the printing operation, the meniscus present near the nozzle opening also minutely vibrates. Consequently, as in the recording head, old ink staying near the nozzle opening is replaced with fresh ink from the pressure generating chamber 49, thereby preventing the nozzle opening from clogging.

Figure 4:
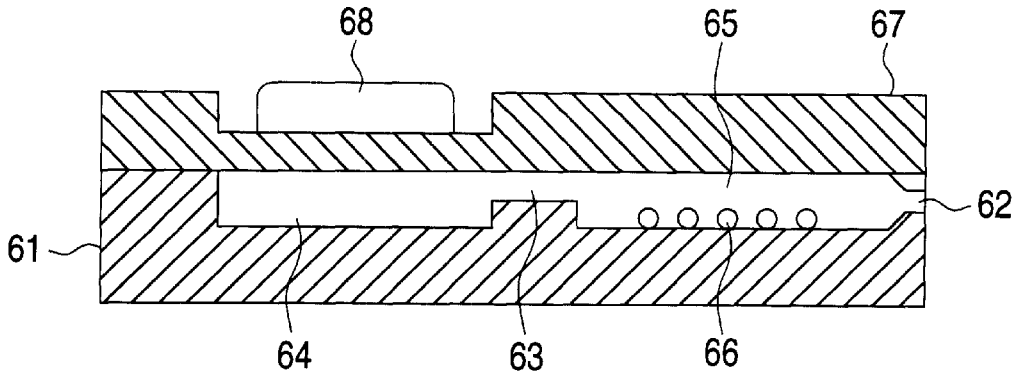
FIG. 4 is a sectional view showing yet another ink-jet recording head that may be used in the ink-jet recording apparatus.

FIG. 4 shows another ink-jet recording head that may be used in the ink-jet recording apparatus in accordance with the present invention. A passage forming plate 61 includes a pressure generating chamber 65 which is connected at one end to a nozzle opening 62 and at the other end to a reservoir 64 through an ink supply port 63. A heating means 66 which, in response to a drive signal, vaporizes ink, is placed at a location to vaporize ink in the pressure generating chamber 65. A cover 67 tightly covers an opening of the passage forming plate 61. A pressure generating means 68, which varies the pressure of the ink in the reservoir 64, is provided on the passage forming plate 61 at a location corresponding to the reservoir 64 of the passage forming plate.

In operation, a drive signal is first applied to the recording head 7. Then, the heating means 66 generates heat. Part of the ink is vaporized in the pressure generating chamber 65, and the ink pressure rises. An ink droplet ejects from the nozzle opening 62 in synchronism with a drive signal. The application of the drive signal is stopped, and the heating means 66 naturally cools down. The pressure in the pressure generating chamber 65 decreases accordingly. Ink flows from the reservoir 65 into the pressure generating chamber 65 through the ink supply port 63, in preparation for the next ink discharging.

The reservoir 64 is pressurized by applying a signal to the pressure generating means 68 of the reservoir. The ink pressure increases in the reservoir 64. The increase of the pressure propagates through the ink supply port 63 to the pressure generating chamber 65. In turn, a meniscus near the nozzle opening 62 is displaced. If the pressure generating means 68 provided in association with the reservoir 64 is driven in synchronism with the printing operation (as in the ink-jet recording head 7 having the pressure generating source of the piezoelectric transducer 23 or 42), the meniscus near the nozzle opening is minutely vibrated. With the minute vibration of the meniscus, ink present near the nozzle opening is replaced with fresh ink from the pressure generating chamber 65. Accordingly, the ink-jet recording head of this example is also capable of preventing the nozzle opening from clogging.

Figure 5:
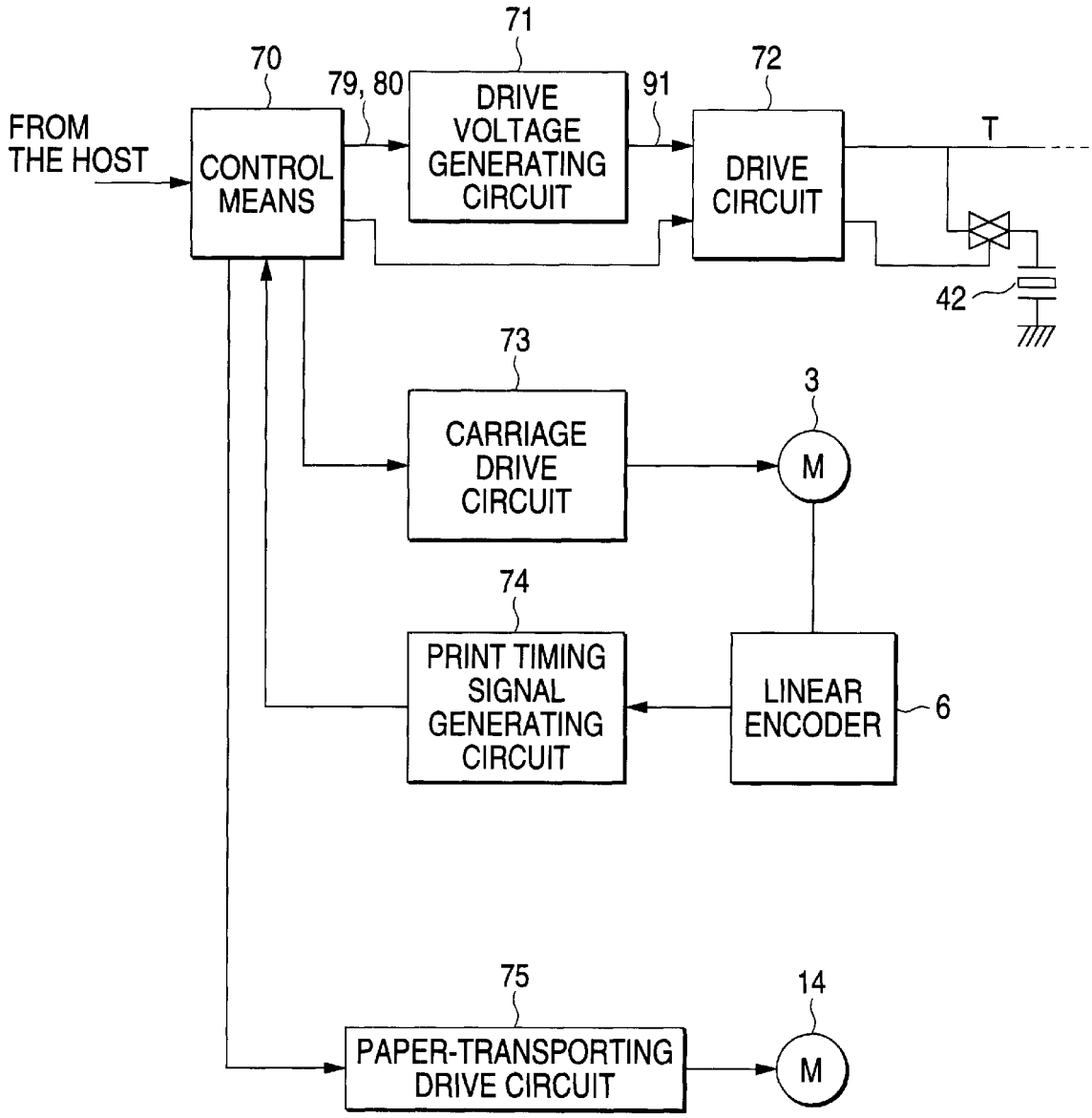
FIG. 5 is a block diagram showing a control system for controlling the operation of an ink-jet recording head as shown in FIG. 3.

An embodiment of a control system for an ink-jet recording apparatus according to the present invention will be described. FIG. 5 shows a control system for controlling the operation of an ink-jet recording head in which the pressure generating means is a piezoelectric transducer of the type which is axially displaced, or a piezoelectric transducer of the longitudinal vibration mode type. In the present embodiment, of the two recording heads 7 and 8, the ink-jet recording head 7 will be described. In FIG. 5, a control means 70 receives print command signals and print data from a host computer, and controls a drive voltage generating circuit 71, a head drive circuit 72, a carriage drive circuit 73, and a paper-transporting drive circuit 75 in accordance with those received signals and data, for various printing and other related operations. Examples of these operations include executing a printing operation, minutely vibrating a meniscus in order to prevent the ink-jet recording head 7 from being clogged, discharging ink from all the nozzle openings, and executing a maintenance operation to forcibly eject ink from the nozzle openings of the head by applying a negative pressure to the head.

The drive voltage generating circuit 71 is designed so as to produce first and second drive voltage signals. The first drive voltage signal is used for reciprocatively displacing a meniscus present near the nozzle opening at a magnitude too small to eject an ink droplet. The second drive voltage signal is used for discharging ink droplets from nozzle openings. The drive signal may be a voltage signal of a trapezoidal waveform consisting of a rising region where the voltage rises at a fixed gradient, a constant region where the voltage maintains a constant value for a given time period, and a falling region where the voltage falls at a fixed gradient. The drive signal may take any other waveform than the trapezoidal waveform if it is suitable for driving the pressure generating means, e.g., a piezoelectric transducer. Another example of a drive signal is a pulse signal of a rectangular waveform.

The head drive circuit 72 outputs the first or second drive voltage signal to the piezoelectric transducer in accordance with print data. A print timing signal generating circuit 74 outputs a print timing signal to the control means 70 in synchronism with a position signal representative of a current position of the ink-jet recording head 7, which is output from the linear encoder 6 with the movement of the carriage 1.

Figure 6:
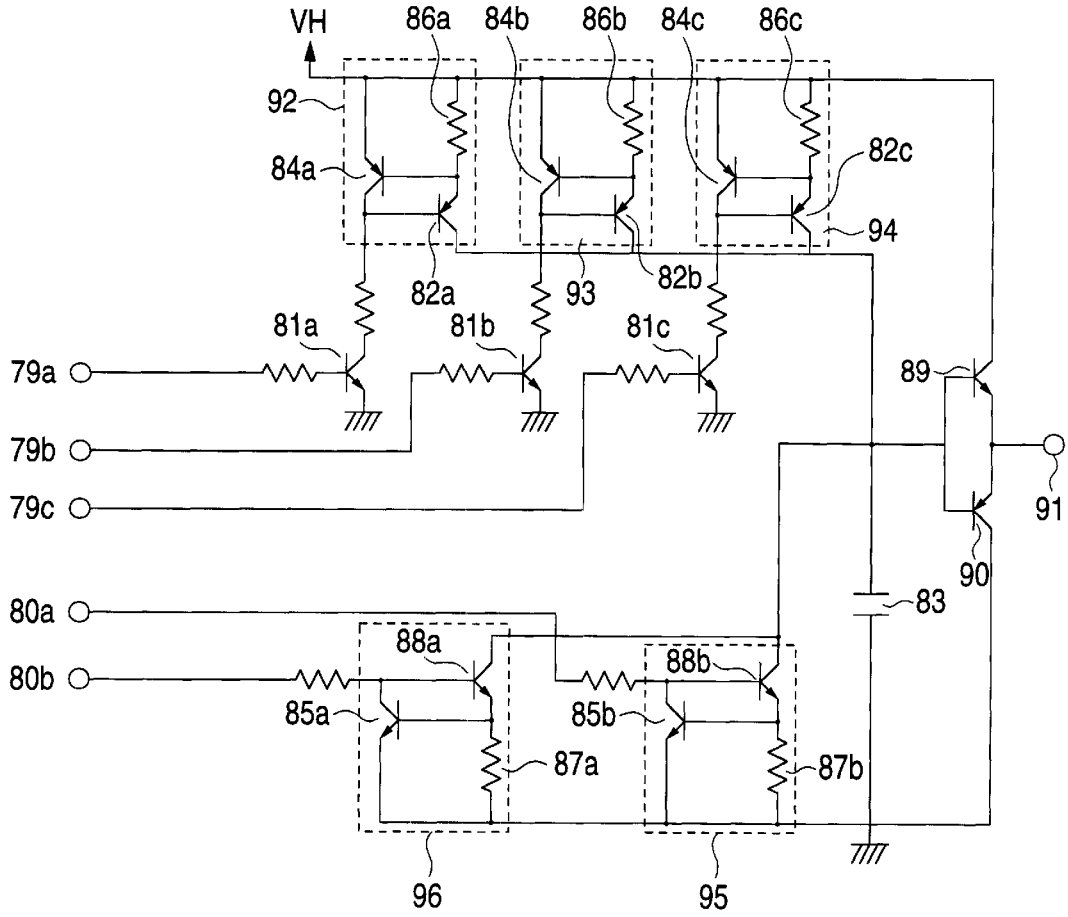
FIG. 6 is a circuit diagram showing a drive voltage generating circuit used in the control means of FIG. 5.
Figure 7:
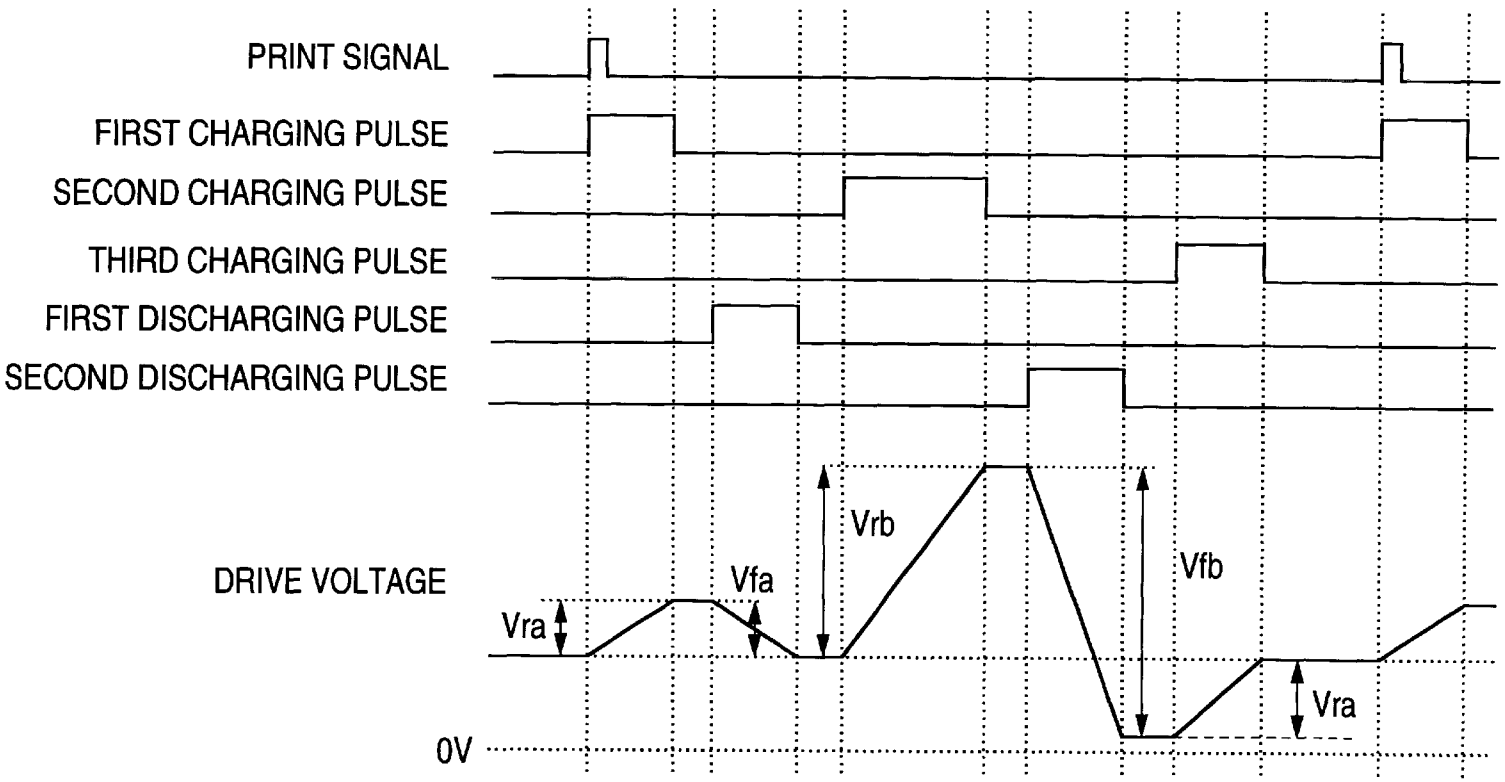
FIG. 7 is a timing diagram of input signals and an output signal of the drive voltage generating circuit of FIG. 6.

FIG. 6 shows a specific example of the drive voltage generating circuit 71. In FIG. 6, numerals 79*a* through 79*c*, and 80*a* and 80*b* designate pulse signals of a fixed pulse width supplied from the control means 70. These signals include a first charging pulse signal 79*a*, a second charging pulse signal 79*b*, a third charging pulse signal 79*c*, a first discharging pulse signal 80*a*, and a second discharging pulse signal 80*b*. These pulse signals are input to the drive voltage generating circuit 71 at timings as shown in FIG. 7. The first charging pulse signal 79*a* is applied to the base of an NPN transistor 81*a* to render it conductive. In turn, a constant current circuit 92 made up of NPN transistors 82*a* and 84*a* and a resistor 86*a* operates to charge a capacitor 83 at a constant current Ira till the voltage across the capacitor 83 reaches a first charging voltage Vra.

The capacitor 83 is charged up to a second charging voltage Vrb at a constant current Irb caused by the second charging pulse 79*b*. The capacitor 83 is charged to a third charging voltage Vrc at a constant current Irc caused by the third charging pulse 79*c*. The first discharging pulse signal 80*a* is applied to a constant current circuit 95 made up of NPN transistors 85*b* and 88*b*, and a resistor 87*b*. In turn, the capacitor 83 is discharged at a constant current Ira till the voltage across the capacitor drops to a first discharging voltage Vfa. Similarly, when the second discharging pulse signal 80*b* is applied to a constant current circuit 96, the capacitor 83 is discharged by a constant current Irb to a second discharging voltage Vfb. Assuming that a base-emitter voltage of the transistor 84*b* is Vbe84*a*, and a resistance of the resistor 86*a* is Rra, Ira=Vbe84*a*/Rra. If a capacitance of the capacitor 83 is C0, the time Tra taken for the voltage across the capacitor to increase to the first charging voltage Vra is: Tra=C0×Vra/Ira.

The same theory is true and applies to other charging circuits. The charging currents Irb and Irc are: Irb=Vbe84*b*/Rrb and Irc=Vbe84*c*/Rrc. The charging rise times Trb and Trc are: Trb=C0×Vrb/Irb and Trc=C0×Vrc/Irc. Assuming that a base-emitter voltage of the transistor 85*a* is Vbe85*a* and a resistance of the resistor 87*a* is Rra, Iras=Vbe85*a*/Rra. The time TFa taken for the voltage across the capacitor to increase to the first discharging voltage Vfa is; Tfa=C0×Vfa/Ifa.

Similarly, the discharging current Ifb is: Ifb=Vbe85*b*/Rfb, and a falling time Tfb: Tfb=C0×Vfb/Ifb. An NPN transistor 89 and a PNP transistor 90 from a current amplifier. A relationship between the pulse signals 79*a* to 79*c*, 80*a* and 80*b* input to the drive voltage generating circuit and a drive voltage signal output at the output terminal thereof is as shown in FIG. 7. The output drive voltage signal takes a trapezoidal waveform, which consists of regions where the amplitude of the signal rises at fixed gradients, regions where the amplitude is constant, and regions where the amplitude falls at fixed gradients. The rising and falling regions are coincident with the pulse widths of the pulse signals, as shown.

The operation of the drive voltage generating circuit 71 will be described. While the drive voltage generating circuit receives the first charging pulse signal 79*a* from the control means 70, the constant current circuit 92 is enabled and a drive voltage signal 91 rises from Vrc to Vra at a fixed gradient. After a preset time elapses, a first discharging pulse signal 80*a* is input to the drive voltage generating circuit, and then the constant current circuit 93 operated. A drive voltage signal appearing at the output terminal 91 drops by the voltage Vfa at a fixed gradient. The drive voltage signal of a trapezoidal waveform vibrates a meniscus at such an amplitude as not to eject an ink droplet (this signal will be referred to as a minute vibration voltage waveform).

After a preset time elapses from the termination of the first discharging pulse signal 80*a*, that is, a time taken for the minutely vibrating meniscus to settle down, a second charging signal 79*b* is input to the drive voltage generating circuit and the output terminal 91 increases by the voltage Vrb. At this time, switching elements T (FIG. 8), such a transmission gates, which are connected to the piezoelectric transducers 42 and driven for printing operations, are turned on by the head drive circuit 72, and the corresponding piezoelectric transducers 42 are charged to a voltage Vrb+Vrc and greatly contract accordingly. In turn, the pressure generating chambers 49 connected to the transducers are expanded. Ink flows from the reservoirs 50 to the pressure generating chambers 49 through the ink supply ports 51. After a preset time elapses from the termination of the second charging pulse 79*b*, a second discharging signal 80*b* is input to the drive voltage generating circuit. The drive voltage signal 91 decreases by the voltage Vfb. As a result, the piezoelectric transducers 42 are discharged to greatly expand. In turn, the pressure generating chambers 49 are greatly contracted, so that ink droplets for printing eject from the nozzle openings 52.

After the discharging of ink droplets, a third charging pulse 79*c* is input to the drive voltage generating circuit, so that the drive voltage signal 91 rises by the voltage Vrc. Here, a sequence of one period ends (hereinafter, a waveform ranging from the inputting of the second charging pulse 79*b* to the inputting of the third charging pulse 79*c* will be referred to as a discharge voltage waveform).

Figure 8:
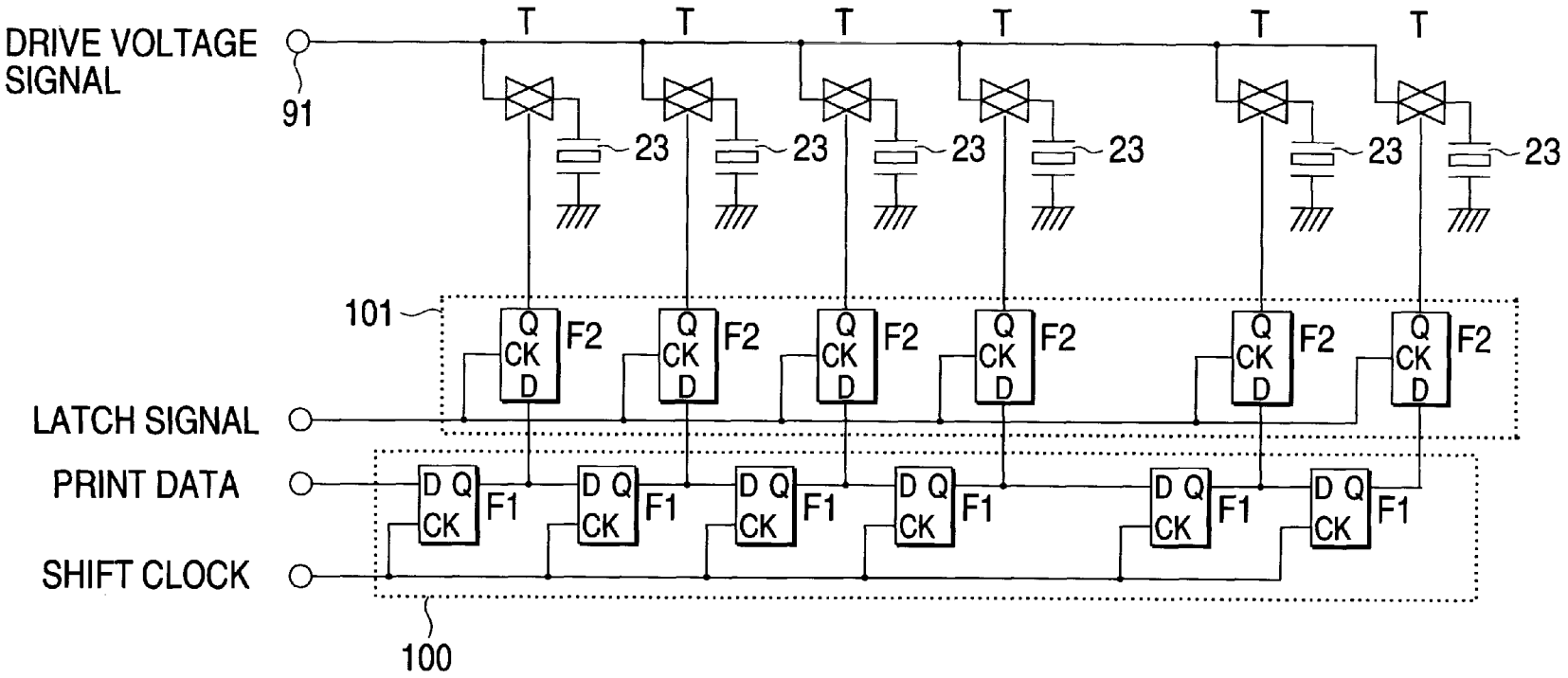
FIG. 8 is a circuit diagram showing a head drive circuit in the control system of FIG. 5.

FIG. 8 shows an example of the head drive circuit 72. In FIG. 8, a shift register 100 is constructed with flip-flops F1 connected in series. The register 100 successively shifts print data in synchronism with a shift clock signal. A latch circuit 101, which consists of flip-flop F2, latches output signals from the flip-flops F1 in response to a latch signal, and outputs control signals to the switching elements T, such as transmission gates, for supplying a drive voltage signal from the output terminal 91 to the piezoelectric transducers 42.

Figure 9:
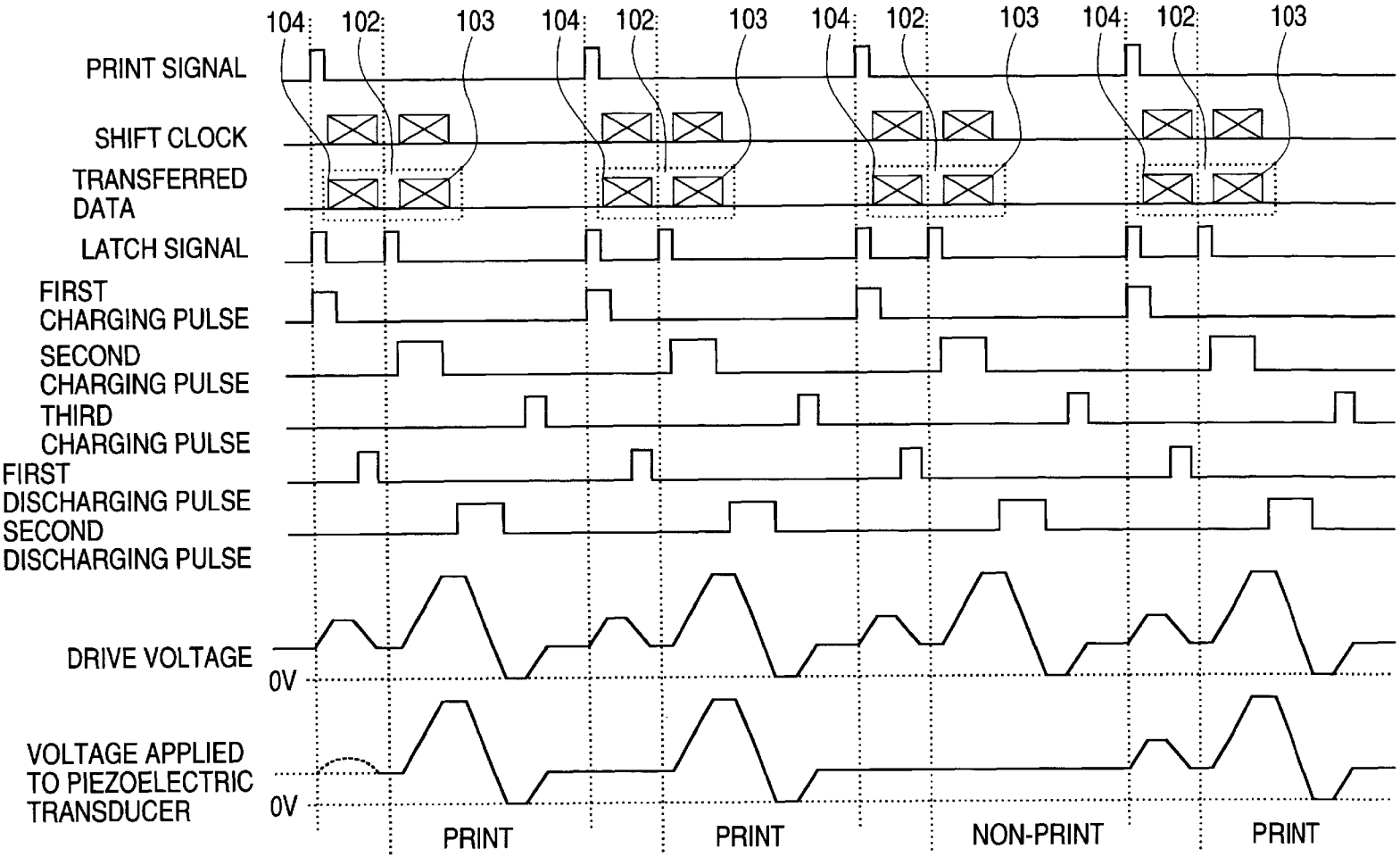
FIG. 9 is a timing diagram showing a printing operation of the head drive circuit of FIG. 8.

FIG. 9 shows a relationship between transfer timings of print data and minute vibration data and a drive voltage applied to the piezoelectric transducer 42. In FIG. 9, reference numeral 102 designates a pair of print data and minute vibration data during one print period. Numeral 103 represents minute vibration data, and numeral 104, print data. For a piezoelectric transducer, the print data 104 is inverted with respect to the minute vibration data 103.

When the head drive circuit receives a print timing signal from the control means 70, the latch circuit 101 latches the minute vibration data 103 that has been transferred in the preceding print timing period, and outputs it as control signals to the switching elements T. In response to the control signals, a minute vibration voltage waveform is applied only to the piezoelectric transducers 42 which have not been driven for the discharging of ink droplets in the preceding print period, through the switching elements T. As a result, only the meniscuses of the nozzle openings 52 which have not ejected ink droplets are minutely vibrated.

Then, the print data 104 is transferred in synchronism with a shift clock signal, and after the minute vibration voltage waveform terminates, at a time where the residual vibration of the minute vibrating meniscus has settled down, a latch signal is output. The switching elements T are controlled in accordance with print data 104. Under the control of the switching elements, a discharge voltage waveform is applied only to the piezoelectric transducers 42 which are to be driven for ink discharging, and ink droplets eject from the corresponding nozzle openings 52. Finally, minute vibration data 103 as the inversion of the print data 104 is transferred in synchronism with a shift clock signal, to thereby complete the sequence of one print period.

In case where the print data and the minute vibration data are transferred in a manner as shown in FIG. 9, a time interval between the discharge voltage waveform and the minute vibration voltage waveform may be set large. If the time interval is large, the vibration characteristic of the meniscus immediately after the ink droplet discharging is not adversely affected. Therefore, there will be very little chance of an unwanted discharging of ink droplets when the minute vibration voltage waveform is applied. Poor print quality and the clogging of the orifices as well are successfully prevented.

Figure 10:
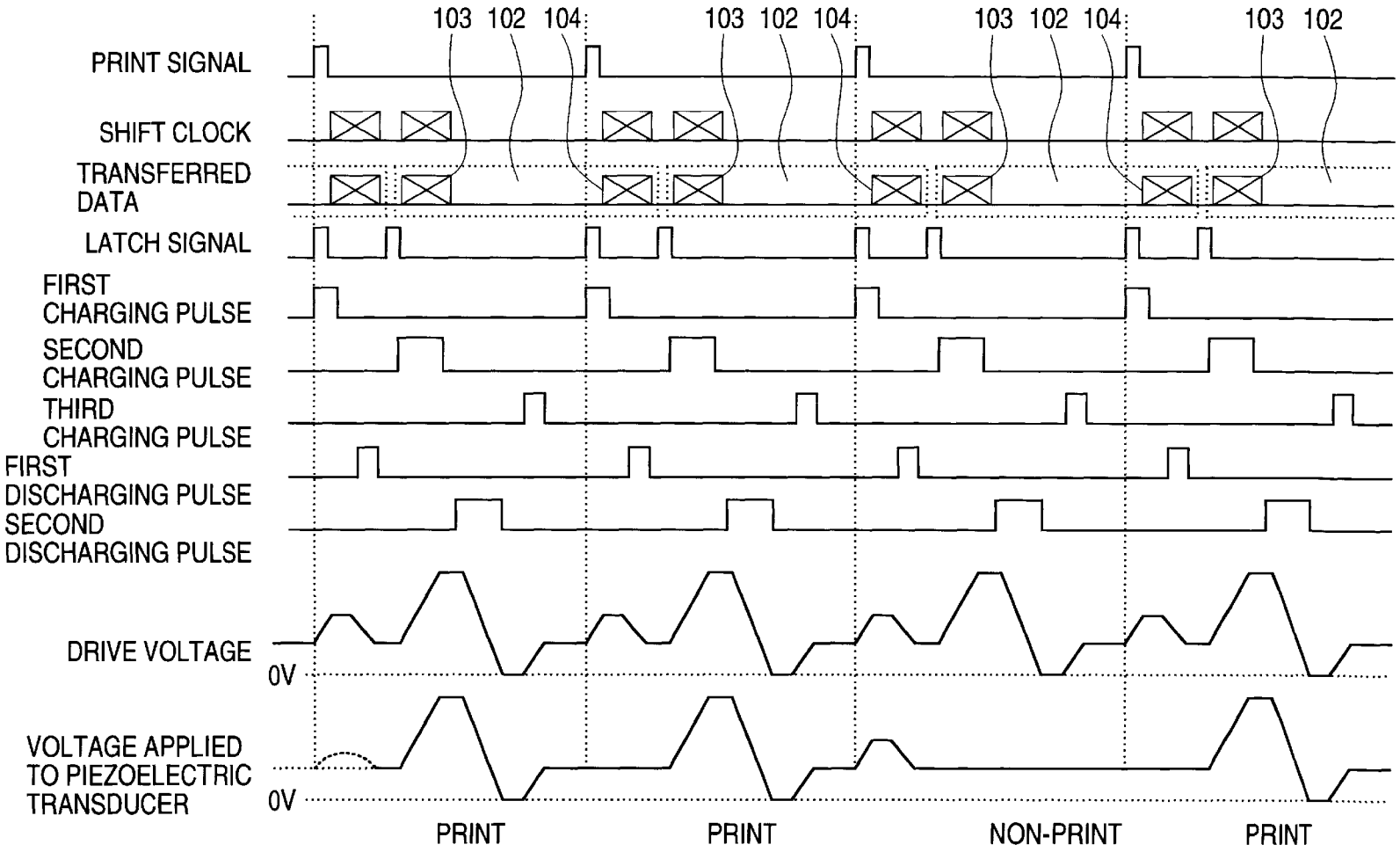
FIG. 10 is a timing diagram showing another printing operation of the head drive circuit.

A timing chart shown in FIG. 10 shows a case where the minute vibration data 103 and the print data 104 are transmitted with a print timing signal being interposed therebetween. A minute vibration voltage waveform is applied to the piezoelectric transducer 42 at the beginning of the nonprint period. In case where the nonprint period follows the print period, a minute vibration voltage waveform is applied for preventing clogging when in a state that a residual vibration of the meniscus caused by the discharging of ink droplets is present. Therefore, the vibration of the meniscus will be greater than that generated by the signals illustrated in FIG. 9. However, that vibration creates no problem in practical use.

Figure 11:
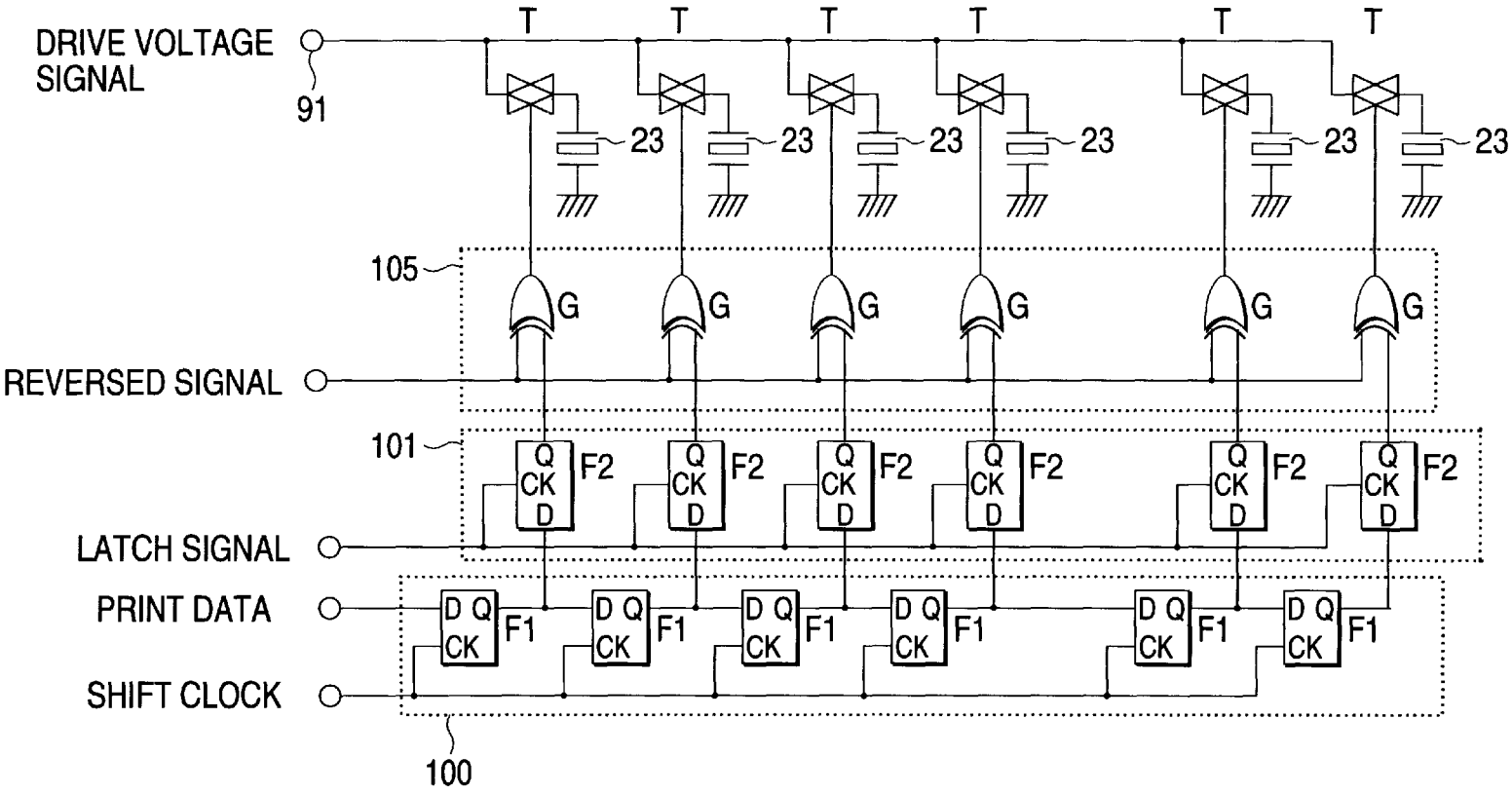
FIG. 11 is a circuit diagram showing another head drive circuit in the control means.
Figure 12:
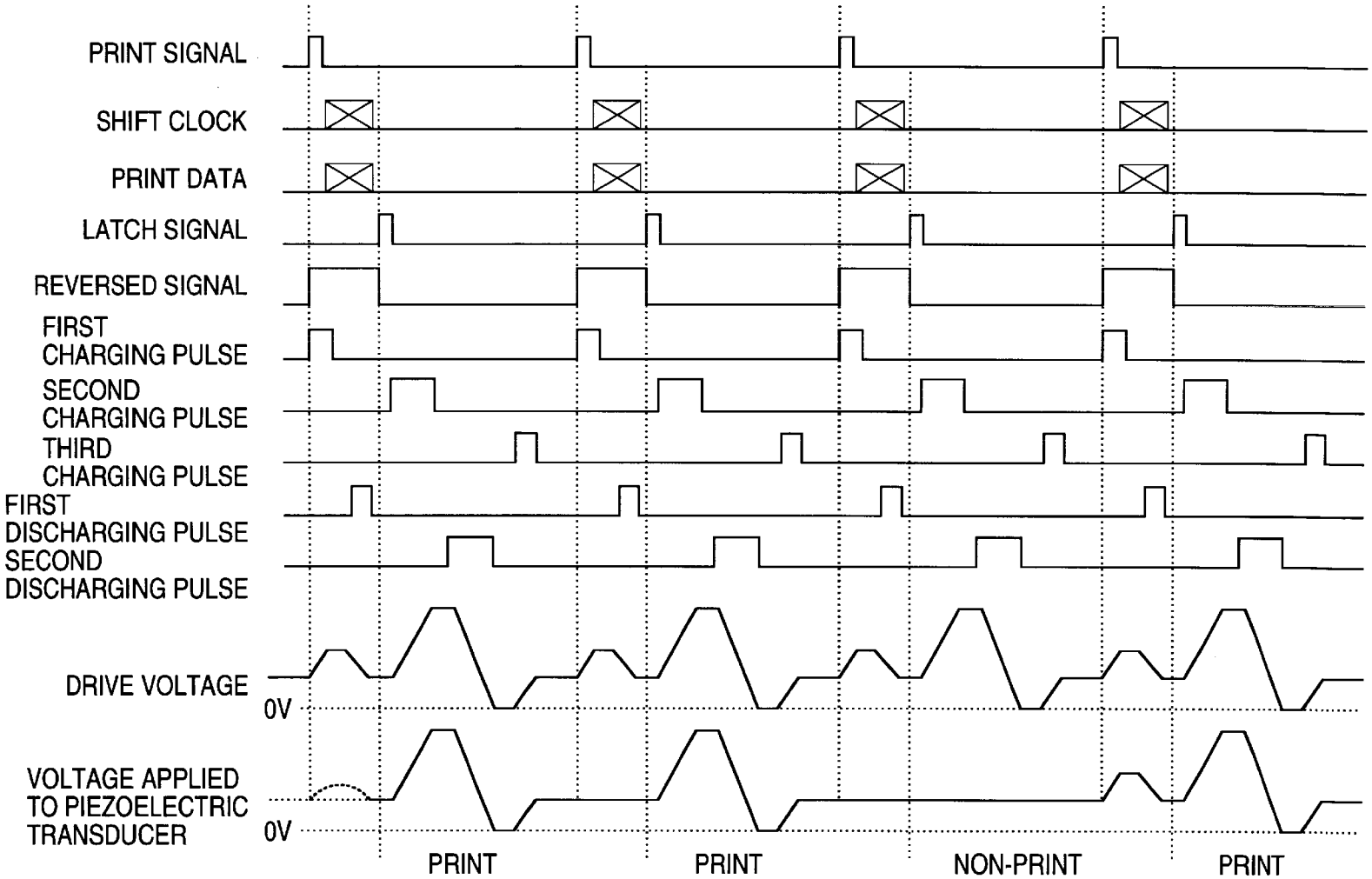
FIG. 12 is a timing diagram showing a printing operation of the head drive circuit of FIG. 11.

FIG. 11 shows another example of the head drive circuit 72. In this example, a data inverting circuit 105 including exclusive-OR gates G is inserted between the latch circuit 101 and the switching elements T. An inverting signal is input to one input terminal of each exclusive-OR gate G, while a signal output from the latch circuit 101 is input to the other input terminal of the gate. With such an arrangement, when the inverting signal is low, the output signal of the latch circuit 101 is straightforwardly applied to the switching element T. When the inverting signal is high, the output signal of the latch circuit 101 is inverted and then applied to the switching element T. The circuit may be arranged such that only the print data 104 is serially transferred with a print timing signal as a trigger signal as shown in FIG. 12, and the print data is latched by the latch circuit 101 at the termination of a minute vibration voltage waveform. In this case, if the inverting signal is set high during only the period where the minute vibration voltage waveform is output, only the print data is transferred. Accordingly, the data transfer rate may be doubled for a clock frequency.

Another embodiment of a control system for an ink-jet recording apparatus according to the present invention will be described.

Figure 13:
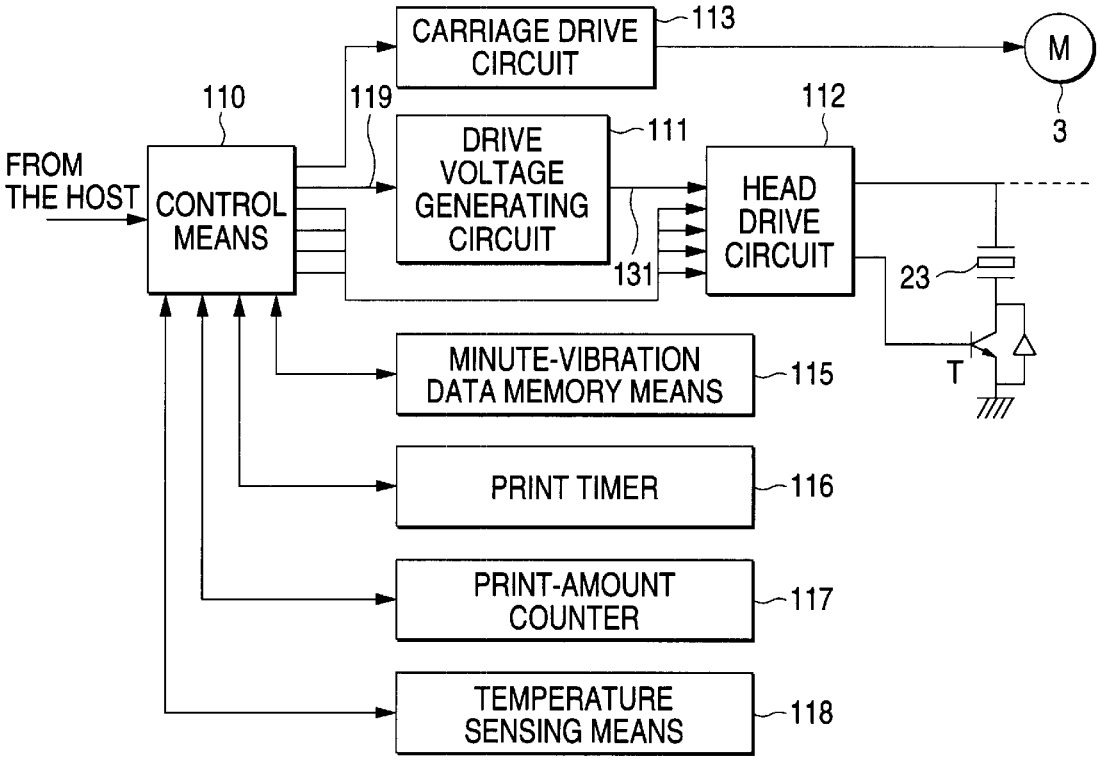
FIG. 13 is a block diagram showing a control system for controlling the operation of an ink-jet recording head as shown in FIG. 2.

FIG. 13 shows another control system for controlling the operation of an ink-jet recording head as shown in FIG. 2. In FIG. 13, a control means 110 receives print command signals and print data from a host computer, and controls a drive voltage generating circuit 111, a head drive circuit 112, and a carriage drive circuit 113 in accordance with those received signals and data, for printing and other related control operations. Examples of those control operations include executing a printing operation, performing a flushing operation at the capping position in accordance with clock data from a print timer 116, adjusting the amplitudes of the second and third drive signals for minutely vibrating the meniscuses for preventing the nozzle openings from being chopped, and printing periods and continuation times.

Figure 14:
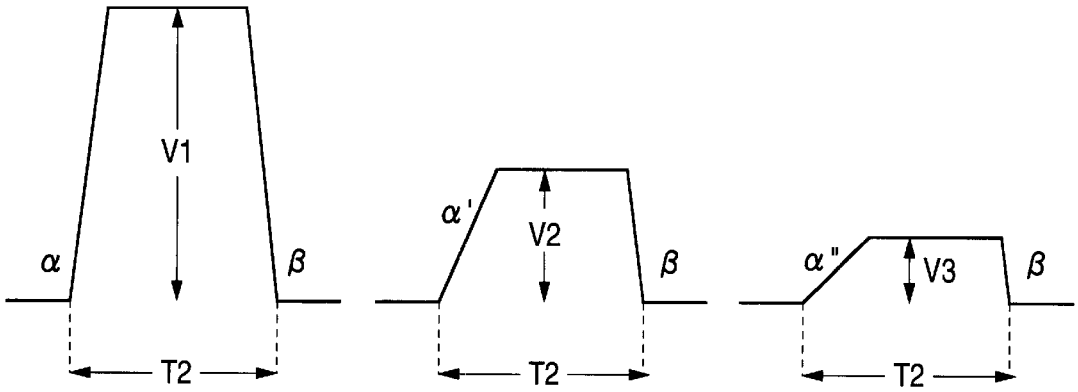
FIGS. 14(*a*) to 14(*c*) are waveforms of first to third drive signals applied to a piezoelectric transducer.

The drive voltage generating circuit 111 is arranged so as to generate a first drive signal (FIG. 14(*a*)) which has a trapezoidal waveform, and is at a voltage V1 high enough to cause an ink droplet to eject from the nozzle openings, and second and third drive signals (FIGS. 14(*b*) and 14(*c*)), which have trapezoidal, waveforms for minutely vibrating the meniscuses present near the nozzle openings 24.

A period t1 of the first drive signal may be set to equal a natural vibration period Tc of the pressure generating chamber 21, which is derived by the equation $$Tc=2\pi\sqrt{[(Cv+Cin)\times Ln\times Li]/(Ln+Li)}$$

wherein:

Ln: inertance of the nozzle opening 24

Li: inertance of the ink supply port

Cv: compliance of the first cover

Cin: compliance of ink

If so set, a displacement of the piezoelectric transducer 23 can effectively be converted into a motion of the meniscus.

The head drive circuit 112 is arranged so as to apply a first drive signal (FIG. 14(*a*)) to those piezoelectric transducers 23 corresponding to print data. In a nonprint mode in which the recording head is positioned in a nonprint area, while waiting for the next printing operation, a second drive signal (FIG. 14(*b*)) is applied to the piezoelectric transducers 23. The voltage of the second drive signal is within a range of 30% to 90% of the voltage of the first drive voltage. When the recording head is moved in the print area, a third drive voltage (FIG. 14(*c*)) is applied to the piezoelectric transducers 23, irrespective of whether or not ink droplets eject for printing (by the first drive signal). The voltage of the third drive signal is approximately 20% of the first drive signal.

A minute-vibration memory means 115 stores the voltage values of the second and third drive signals, data for adjusting a gradient of the second drive signal in accordance with temperature, and data for adjusting a level of the second drive signal in accordance with the amount of ink consumed by the printing operation.

The print timer 116 is a timer for counting the duration of the printing operation. The timer is driven to start the counting when a printing operation starts, and to stop when a flushing operation starts. A print-amount counter 117 counts the number of dots printed in a print mode to detect the amount of consumed ink. A temperature sensing means 118 senses the temperature around the ink-jet recording head 7.

Figure 15:
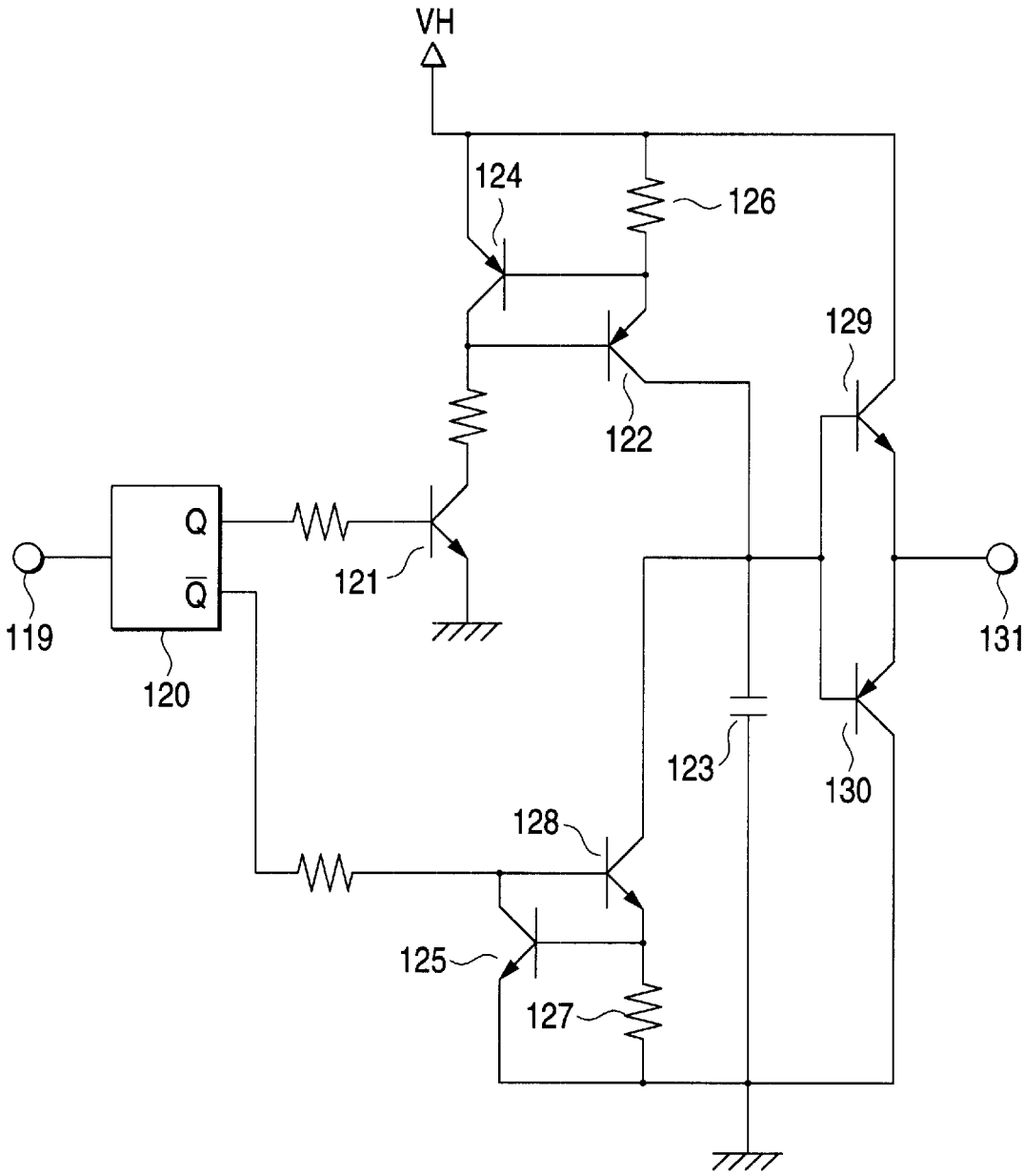
FIG. 15 is a circuit diagram showing a drive voltage generating circuit in the control system of FIG. 13.

FIG. 15 shows a specific example of the drive voltage generating circuit 111. In FIG. 15, a one-shot multibrator 120 converts a timing signal received from an external device to a pulse signal of a fixed width. The multivibrator outputs a positive signal and a negative signal in synchronism with a timing signal. One of the output terminals of the one-shot multivibrator is connected through a resistor to the base of an NPN transistor 121 of which the collector is connected through a resistor to the base of a PNP transistor 122. When the multivibrator receives a timing signal, a capacitor 123 is charged at a constant current Ir till the voltage across the capacitor 123 reaches a power source voltage VH. The other terminal of the one-shot multivibrator 120 is connected to an NPN transistor 128. When the timing signal changes states, the transistor 22 is turned off, while the transistor 128 is turned on. As a result, the capacitor 123 is discharged at a constant current If to about zero (0) volts.

The charging current Ir is given by $$Ir=Vbe\mathbf{124}/Rr$$

wherein:

Vbe124: base-emitter voltage of the transistor 124

Rr: resistance of the resistor 126

A rise time T of the charging voltage is given by:

$$T=C0=VH/Tr$$

The discharging current If of the drive signal is given by:

$$If=Vbe\mathbf{125}/Rr$$

wherein:

Vbe125: base-emitter voltage of the transistor 125

Rr: resistance of the resistor 127

A falling time is given by:

$$Tf=C0\times VH/If$$

Accordingly, a voltage across the capacitor 123 has a trapezoidal waveform consisting of a rising region where the voltage rises at a fixed gradient α, a constant region where the voltage maintains a constant value, and a falling region where the voltage falls at a fixed gradient β, as shown in FIG. 14(*a*). The capacitor voltage is amplified by the transistor 129 and 130. The amplified voltage is output in the form of a drive signal from an output terminal 131 to the piezoelectric transducers 23.

An operation of the drive voltage generating circuit 111 will be described.

The switching elements T, such as switching transistors, are turned on for a short period of time in response to a signal from the head drive circuit 112. Then, the piezoelectric transducers 23 are charged under the voltage from the drive voltage generating circuit 111. During the charging operation, the pulse signal falls to turn off the switching elements T. The charging operation stops at a voltage determined by a time period till the switching elements are turned off.

By properly selecting a charging time in the drive voltage generating circuit 111 shown in FIG. 15 and the resistance values of the resistor 126 and the like, it is possible to generate a second drive signal (FIG. 14(*b*)) having a charging gradient α' which is capable of causing a minute vibration at an amplitude suitable to prevent clogging and a third drive signal (FIG. 14(*c*)) having a charging gradient α" which is capable of causing a minute vibration at such an amplitude as to be suitable for preventing clogging when the recording head moves in the print area. It is preferable that the charging gradients α' and α" of the second and third drive voltages are selected to be within 5% to 50% of the gradient α when the charging is performed by the first drive signal.

The voltage values V2 and V3 of the second and third drive signals are each smaller than the voltage value V1 of the first drive signal (FIG. 14(*a*)) for discharging the ink droplet. Accordingly, the second or third drive signal displaces the piezoelectric transducer 23 at such a magnitude as not to eject the ink droplet from the nozzle opening, and minutely expands and contracts the pressure generating chamber 21 to minutely vibrate a meniscus near the nozzle opening 24. If the period t1 of the second or third drive signal is selected to be equal to that of the first drive signal for discharging the ink droplet, it is equal to the natural vibration period of the pressure generating chamber 21. As a result, the meniscus can efficiently be vibrated at an amplitude high enough to prevent the clogging of the nozzle opening, through little displacement of the piezoelectric transducer 23.

A print signal output from the control means 110 turns the transistors 122 and 123 on and off to generate a voltage signal of a trapezoidal waveform, or a first drive signal. The switching elements T connected to other piezoelectric transducers 23 to be driven for the printing operations are turned on by the head drive circuit 112. Accordingly, those transducers are charged to the voltage VH by the drive signal. As a result, a drive signal generated in the drive voltage generating circuit 111 flows into the piezoelectric transducers 23 and charges them at constant current. Those transducers to be driven for the printing operation displace toward the pressure generating chambers 12, so that these chambers are contracted to eject ink droplets from the nozzle openings 24. After a preset time elapses, the transistor 128 is turned on to discharge the capacitor 123. In turn, the piezoelectric transducers 23 are discharged to restore from their displaced state. The pressure generating chambers 21 are expanded, so that ink flows from the reservoirs 26 into the pressure generating chambers 21. Subsequently, when the recording head is moving in the print area, the piezoelectric transducers 23 receive a third drive signal capable of causing a minute vibration of the meniscus before the discharging of ink droplets, in synchronism with a timing signal. Then, the transducers receive a first drive signal capable of discharging ink droplets. The piezoelectric transducers 23, which are not driven in a printing operation, receive only a third drive signal. Therefore, the meniscuses near all the nozzle openings 24 are minutely vibrated in print periods.

When the ink-jet recording head 7 is placed in a nonprint area, the piezoelectric transducers 23 receive a second drive signal of which the voltage is within a range of 30% to 90% of that of the first drive signal. Accordingly, the meniscus is minutely vibrated by a drive force larger than when the recording head is in the print area.

Figure 16:
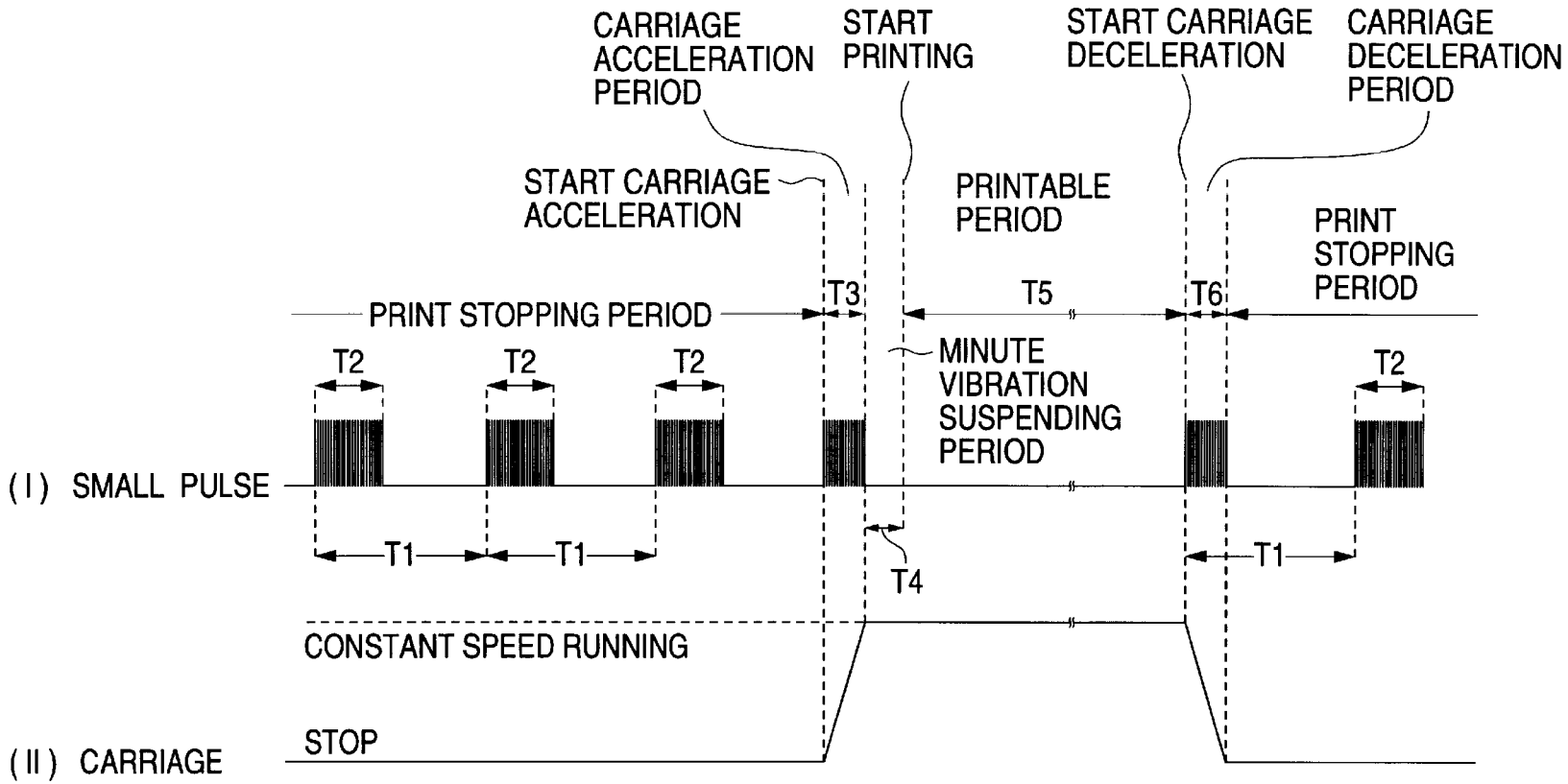
FIG. 16 is a diagram showing drive signals applied to the piezoelectric transducer during a print rest period with respect to the movement of a carriage.
Figure 17:
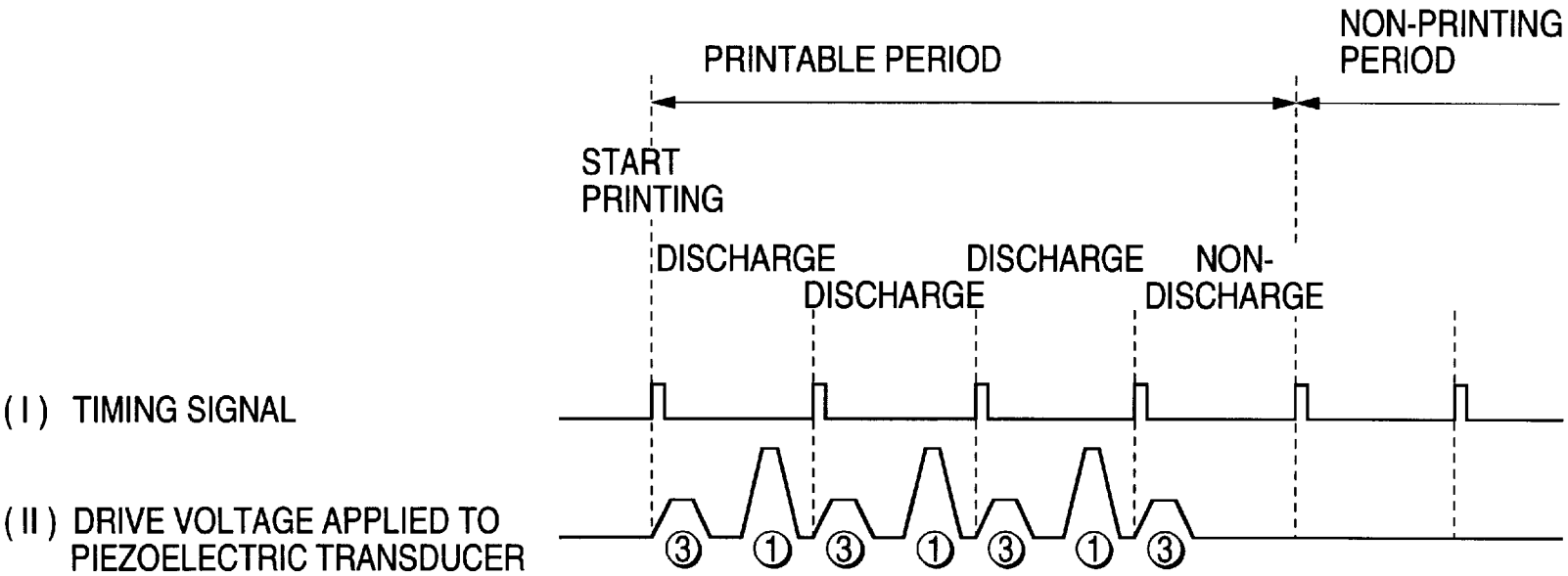
FIG. 17 is a waveform diagram showing first and third drive signals applied to piezoelectric transducers operated for discharging ink droplets and piezoelectric transducers not operated for discharging ink droplets when the recording head is in a print period.

An operation of the control system for an ink-jet recording apparatus will be described with reference to the timing charts shown in FIGS. 16 and 17.

When the ink-jet recording head 7 is positioned in a nonprint area and not sealed by the cap member 11, the control means 110 reads out data to determine a minute vibration during a rest period, from the minute-vibration memory means 115, and applies a second drive signal to the piezoelectric transducer for a time duration T2 at periods T1.

The period T1 is preferably shorter than the sum (T2+T5) of the duration T2 of the second drive signal and a period (printable period) T5 required for the ink-jet recording head 7 to move in the print area. In the case of an ink-jet recording apparatus having a printable period T5 of 750 ms, for example, a cycle consisting of a period T1, a period T2 and an additional period may be repeated. In this case, the period T1 is 755 ms, the period T2 for causing a succession of minute vibrations (e.g., 1080 vibrations) during the period T1 is 75 ms, and the additional period is 680 ms, which follows the period T2, during which the minute vibration is suspended.

Thus, the meniscus is minutely vibrated for the period T2 at the periods T1 shorter than a time period causing the clogging of the nozzle opening, whereby the mixing of ink near the nozzle opening with ink in the pressure generating chamber 21 is promoted, to decrease the viscosity of ink present near the nozzle opening and hence to prevent the clogging of the orifice. Further, the minute vibration is suspended after a preset time. Thus, before the piezoelectric transducer 23 is heated, it then is cooled down (by the lose of Joule's heat), and fatigue of the piezoelectric transducer 23 is lessened; otherwise, the transducer is continuously operated and fatigue becomes great.

As the recording head waits for the next printing operation, a plurality of minute vibrations are intermittently repeated. When a print signal is applied to the recording head, the carriage 1 starts to move. In turn, the control means 110 suspends the intermittent minute vibrations at fixed periods T1, and accelerates the carriage 1 to a printable speed. When the minute vibration is suspended, a print signal is input to the control system for the recording head, a movement of the carriage 1 is detected and a second drive signal is applied to the recording head 7. During a period T3 where the carriage 1 is being accelerated, the meniscus is minutely vibrated, so that the viscosity of ink which is increasing because of the air passing the nozzle opening is mixed with ink of relatively low viscosity in the pressure generating chamber 31, to thereby minimize the rise of the ink near the nozzle opening. After the carriage 1 is accelerated and its speed reaches a printable speed, the application of the second drive signal is suspended at time T4, e.g., 10 ms, prior to the time where the drive voltage signal is applied to the piezoelectric transducers, to suspend the minute vibration of the meniscus that has continued during the acceleration period and to settle down the meniscus in a state suitable for the printing. During the printing, for example, at the beginning of the print period, a third drive signal (3) is first output to the piezoelectric transducer 23, to thereby minutely vibrate a meniscus present near the nozzle opening 24. Then, a first drive signal (1) corresponding to print data is output thereto. A third drive signal (3) is applied to the piezoelectric transducer (FIG. 17(II), to prevent the clogging of the nozzle opening.

While the recording head 7 is moved in the width-wise direction of the recording sheet 5, a third drive signal (3) is applied to the piezoelectric transducer 23 associated with the nozzle opening 24 to be used for dot formation, to minutely vibrate the meniscuses near the nozzle openings and hence to decrease an increased viscosity of the ink near the nozzle opening to a viscosity level suitable for printing, by mixing that ink with the ink in the pressure generating chamber 21. At the time when the application of the third drive signal (3) ends, the third drive signal is applied to the piezoelectric transducer. As the result of its voltage rise, the pressure generating chamber 21 is contracted, so that an ink droplet ejects through the nozzle opening to form a dot. After a preset time elapses, the voltage of the first drive signal (1) drops, so that the pressure generating chamber 21 resumes its original state to suck ink from the reservoir 26.

A third drive signal (3) is applied to the piezoelectric transducers 23 associated with the nozzle openings not used for dot formation, as it is applied to the piezoelectric transducers 23 driven for printing operations, whereby the meniscuses near those nozzle openings are minutely vibrated. By the minute vibration of the meniscuses, the ink near the nozzle openings which are not discharging ink droplets is mixed with the ink in the pressure generating chambers 21, so that the viscosity of the former is decreased.

When the printing of one pass ends and the recording head 7 starts to decelerate is suspend operation, the control means 110 applies a second rive signal to all the piezoelectric transducers 23. In turn, during the deceleration period T6, the carriage 1 is decelerated to a stop position while the meniscuses near the nozzle openings 24 are minutely vibrated. When the carriage 1 stops, a second rive signal is continuously applied for the duration T2 at periods T1. As already stated, the period T1 is preferably shorter than the sum (T2+T5) of the period T2 of the second drive signal and a period (printable period) T5 required for the ink-jet recording head 7 to move in the print area. Thus, the meniscus is minutely vibrated for the period T2 at the periods T1 shorter than a time period causing the clogging of the nozzle opening, whereby the mixing of ink near the nozzle opening with ink in the pressure generating chamber 21 is promoted, to decrease the viscosity of ink present near the nozzle opening and hence to prevent the clogging of the orifice. Further, the minute vibration is suspended, whereby the piezoelectric transducer 23 that is heated is cooled down (by the loss of Joule's heat), such that fatigue of the piezoelectric transducer 23 is lessened; otherwise, the transducer is continuously operated and fatigue becomes great.

In the present embodiment, when the printing of one path ends, the recording head 7 starts to decelerate for stopping its operation, and all the piezoelectric transducers 23 come to a standstill while receiving the second drive signal, the control means 110 detects a time period T1 from the deceleration starting point, and at this time applies a second drive signal to be applied at the rest of printing for the time duration T2 at periods T1, to the piezeoelectric transducer to minutely vibrate the transducer.

Figure 18:
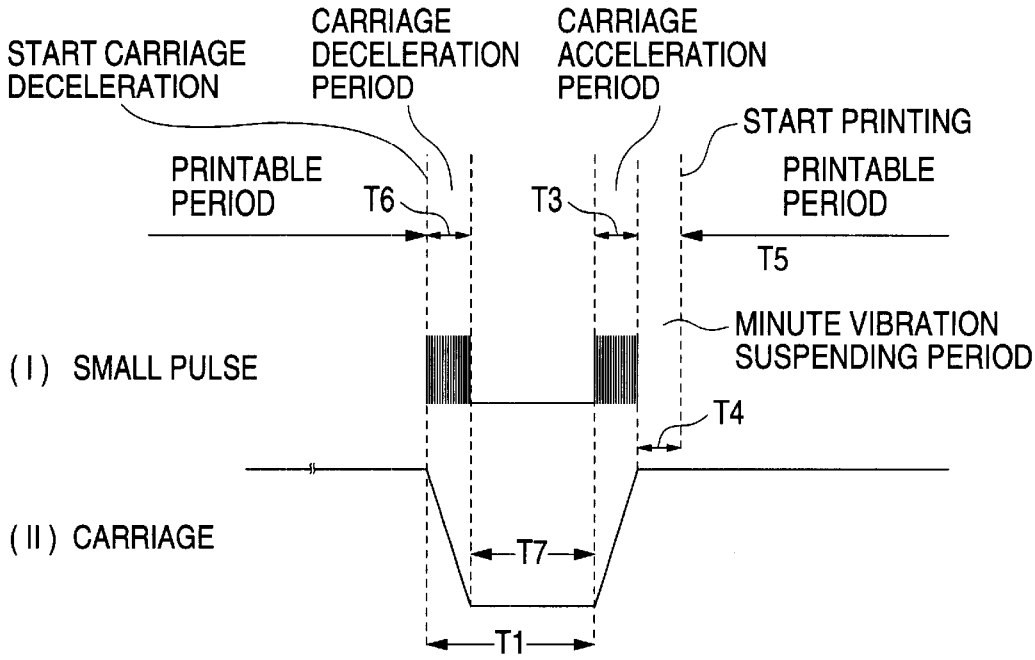
FIGS. 18(*a*) and 18(*b*) are diagrams showing how a third drive signal is applied to the piezoelectric transducer when the recording head completes a printing operation of one pass, and decelerates to a standstill position.
Figure 18:
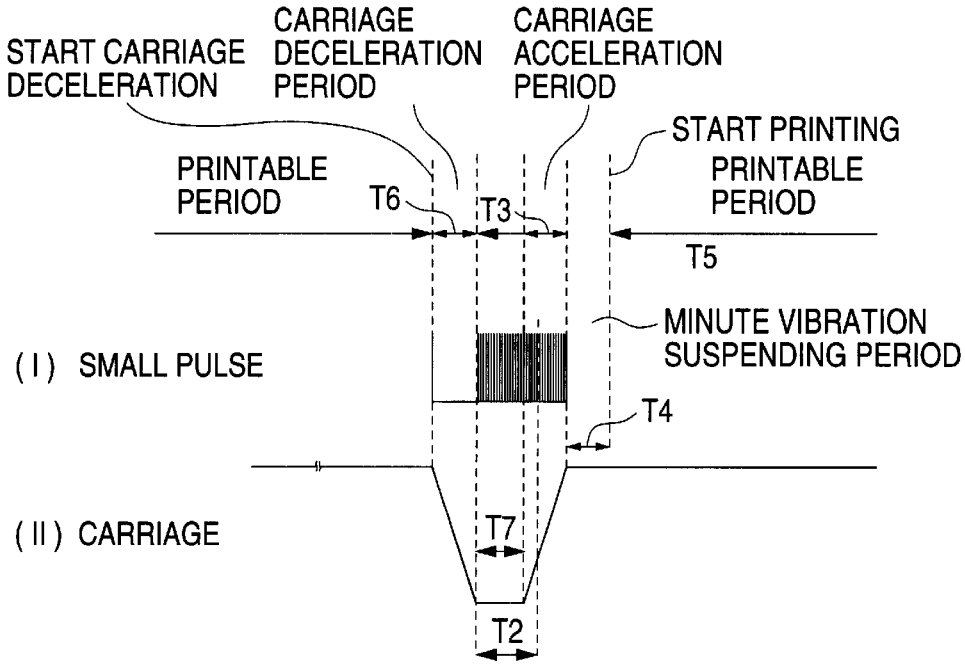

Another manner as shown in FIG. 18(*a*) illustrates another alternative. As shown, the control system for the recording head receives a print signal and starts to accelerate the carriage 1 when a time shorter than the period T1 of the second drive signal elapses from the deceleration start point. At this time, the second drive signal is applied for an acceleration time T3 of the carriage 1, not the duration T2. As in the previous case, when the speed of the carriage 1 reaches a constant speed, the minute vibration is suspended for a period T4, and then the recording head starts a printing operation.

In the present embodiment, the second drive signal is applied during the deceleration of the carriage 1. The second drive signal may be applied in a manner as shown in FIG. 18(*b*). In this manner, the second drive signal is applied at a time when deceleration of the carriage ends and the carriage stops, not during the deceleration, and the application of the second drive signal continues for a period of T2, to thereby minutely vibrate the related meniscus. When a rest time T7 of the carriage 1 is shorter than the duration T2 of the second drive signal and the carriage 1 is accelerated again, the second drive signal being applied is immediately stopped and a second drive signal that is to be applied when the carriage 1 is accelerated is applied instead.

Figure 19:
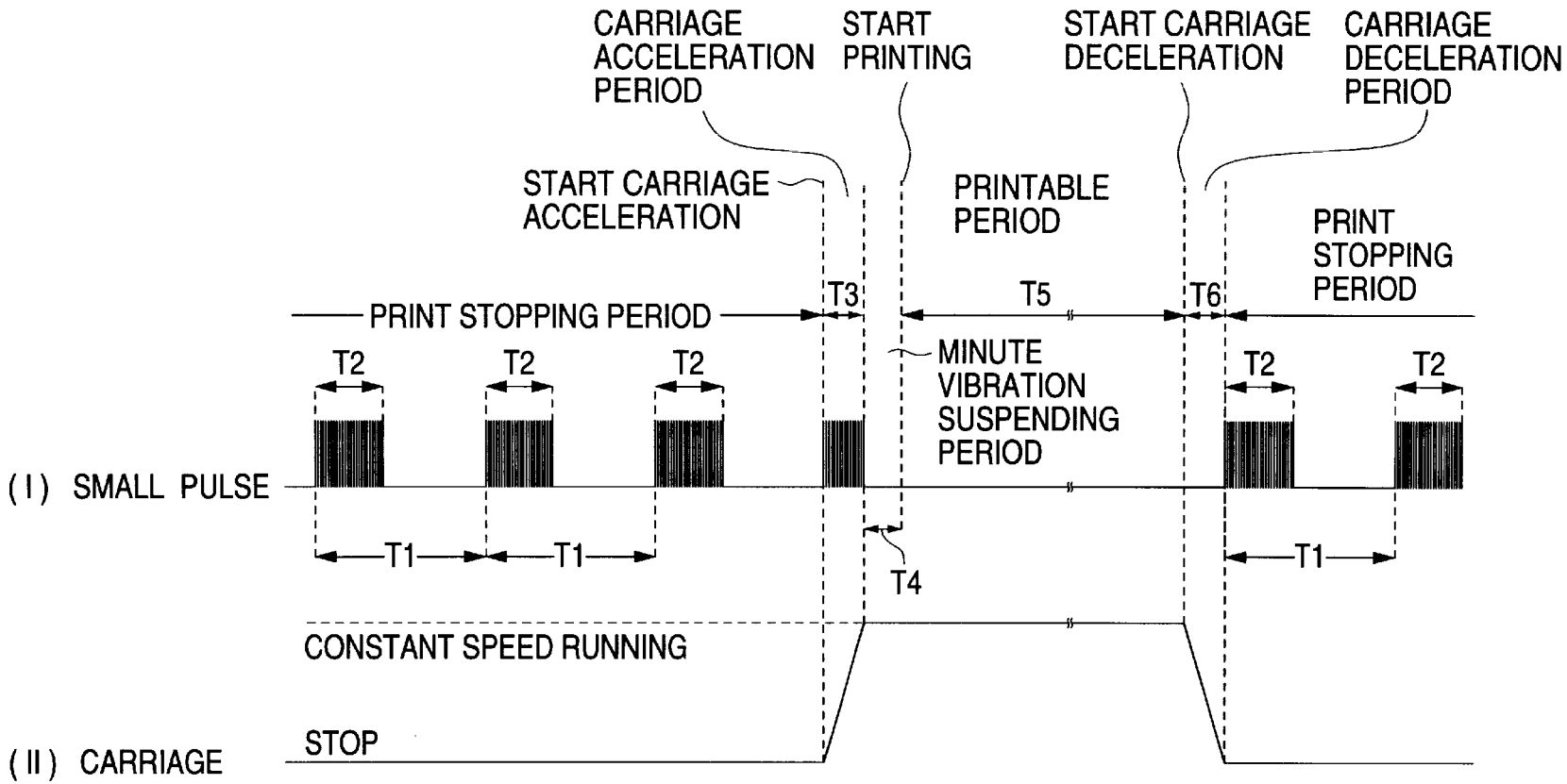
FIG. 19 is a diagram showing another method of applying drive signals to the piezoelectric transducer during a print rest period with respect to the movement of a carriage.

In the recording head of the type in which ink is hard to evaporate and the nozzle openings 24 are hard to clog, or in a case where a suspending time T2' of the carriage 1 is very short as when continuous printing is being performed, the second drive signal is applied to the piezoelectric transducers at periods T1 when the carriage 1 stops, not during the deceleration period of the carriage 1, as shown in FIG. 19. Also, in this case, to prevent the clogging at the start of the printing, as in the previous case, it is preferable to apply the second drive signal when the acceleration of the carriage 1 starts, to minutely vibrate the related meniscuses.

Thus, a printing operation is carried cut while the carriage 1 repeatedly accelerates, maintains a constant speed, and decelerates. When the print timer 116 counts a preset time, e.g., 10 seconds, the control means 110 moves the recording head 7 to a flushing position, or a position facing an ink receptacle, for example, the cap member 11, and ejects a predetermined number of ink droplets, e.g., 1000 dots, through the nozzle openings for a periodical flushing. When the flushing operation ends, the print timer 116 is reset and begins counting, and the recording head starts a printing operation again, through the sequence of operations as mentioned above. Subsequently, the periodic flushing is carried out every time the drive voltage generating circuit 111 counts a preset time, to eject ink droplets through all the nozzle openings and thus to prevent clogging.

Figure 20:
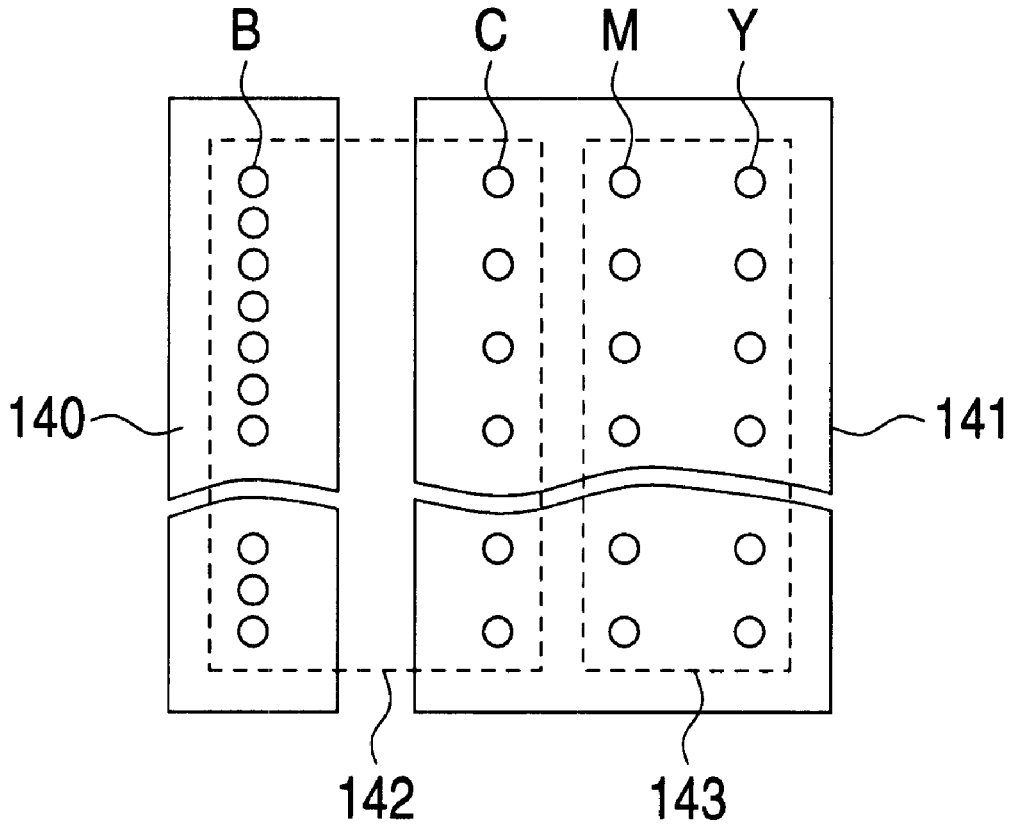
FIG. 20 is a diagram showing arrays of nozzle openings of an ink-jet recording head to which the present invention is applicable.
Figure 21:
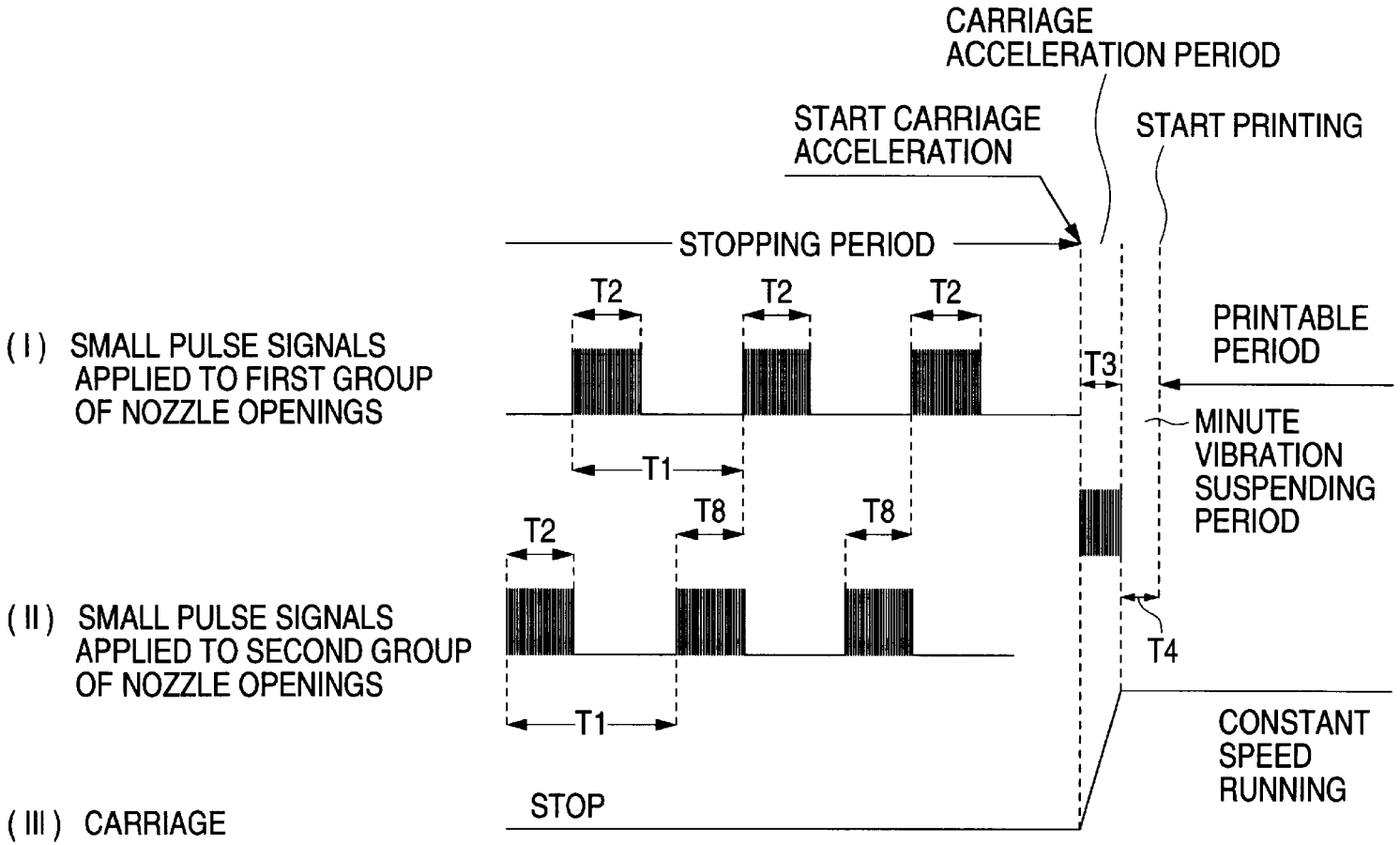
FIG. 21 is a diagram showing still another method of applying driving signals to the piezoelectric transducer during a print rest period with respect to the carriage movement.

Recording heads 140 and 141 are illustrated in FIG. 20. In these recording heads, linear arrays of nozzle openings are independently driven. The orifice arrays include an orifice array B for discharging black ink, an orifice array C for discharging cyan ink, an orifice array N for discharging magenta ink, and an orifice array Y for discharging yellow ink. Those orifice arrays B, C, N and T are arranged into two groups 142 and 143. In this case, it is preferable that the second drive signal which is to be applied at the rest of printing is applied to those groups 142 and 143, while being staggered by a time difference T2. If so staggered, the audible sound caused by the minute vibration is reduced to a factor of the number of groups. Accordingly, the total noise generated by the apparatus is reduced.

In the present embodiment, the removal of a rest state is detected by the movement of the carriage 1. It may also be detected depending on the presence or absence of the inputting of a print signal coming from an external device.

In the embodiment mentioned above, the level of the second drive signal applied to the piezoelectric transducer 23 during a rest period in the nonprint area for minutely vibrating the meniscus, is kept constant. In an alternative, the recording head 7 detects a print area or an amount of ink ejecting in the periodic flushing on the basis of data from the print-amount counter 117. When the amount of ejecting ink is large, the voltage of the second drive signal is decreased. When the amount of ejecting ink is small, the second drive signal is increased within a range of such values as not to eject the ink droplet, and the meniscus is minutely vibrated, allowing for the viscosity of ink in the pressure generating chamber 21. The alternative minimizes the load of the piezoelectric transducer 23 during a reset period and further reliably prevents the clogging of the nozzle openings. The level of the second drive signal corresponding to the amount of ejecting ink during the print periods can easily be set in a manner that relationships between the amounts of ejecting ink and the voltage values are stored in advance in the minute-vibration memory means 115, and a voltage value corresponding to ejecting ink amount data from the print-amount counter 117 is read out of the memory.

The viscosity of ink used by the ink-jet recording apparatus of the invention depends largely on temperature. Accordingly, when a low voltage signal is applied to the piezoelectric transducer 23 to minutely vibrate a meniscus associated therewith, the amplitude of a minute vibration is greatly influenced by temperature. One of the possible ways to solve the problem is the adjust a voltage level. In this case, the control of a charging time is essential, so that the related circuit is complicated. In the present invention, the second drive signal is kept at a constant voltage value (V2), while a rising gradient and a falling gradient are adjusted in accordance with the ambient temperature. Specifically, for room temperature (25° C.), the rising gradient $\alpha$ is set at 4V/$\mu$s, and the falling gradient $\beta$ is set at 6.7 V/$\mu$s. For low temperatures, such as 5° C., the rising gradient $\alpha 1$ is set at 5V/$\mu$s, and the falling gradient $\beta 1$ is 8.4 V/$\mu$s. For higher temperatures, the rising gradient $\alpha 2$ is set at 3V/$\mu$s, and the falling gradient $\beta 2$ is 5 V/$\mu$s. A flexural displacing velocity and a restoring velocity of the piezoelectric transducer 23 are increased as the temperature decreases, to thereby increase the fluidity of ink whose viscosity is increased as the result of the low temperature. The rising and falling gradients $\alpha$, $\alpha 1$ and $\alpha 2$, and $\beta$, $\beta 1$ and $\beta 2$ for those respective temperatures may readily be adjusted in a manner that the relationships between temperatures and those gradients $\alpha$, $\alpha 1$ and $\alpha 2$, and $\beta$, $\beta 1$ and $\beta 2$ are stored in advance in the memory, and desired gradients are read out of the memory by addressing the memory with a temperature signal from the temperature sensing means 118.

In the present embodiment, the third drive signal is set at a fixed value, which is about 20% of the drive signal with respect to room temperature, e.g., 25° C. For the ink whose viscosity depends largely on temperature, the value is set at a value which is about 10% of the drive signal when the temperature is low, about 10° C., and about 30% of the drive signal when temperature is high, about 40° C. By adjusting the value in this manner, the meniscus may be minutely vibrated in a satisfactory manner while compensating for variations in temperature.

In the above-mentioned embodiment, the recording head is operated for printing such that a third drive signal is first applied to the piezoelectric transducer to minutely vibrate the transducer and the related meniscus, and after the meniscus settles down, a first drive signal is applied to eject ink droplets for printing. Alternatively, after the first drive signal is applied, the third drive signal is applied to minutely vibrate the piezoelectric transducer and the like for preventing clogging.

Figure 22:
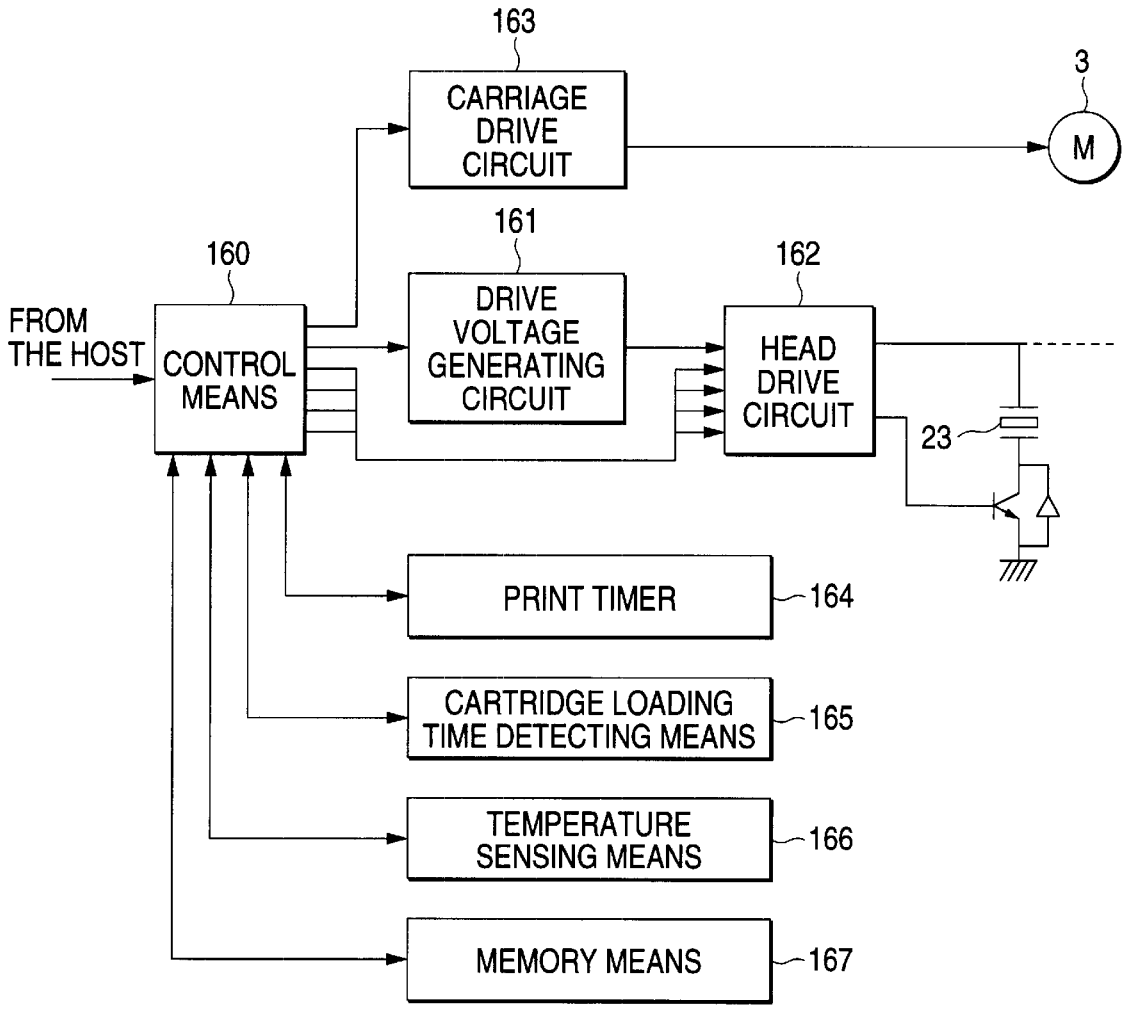
FIG. 22 is a block diagram showing another control system for controlling the operation of an ink-jet recording head as shown in FIG. 2.

FIG. 22 shows yet another control system for controlling the operation of an ink-jet recording head as shown in FIG. 2. A control means 160 receives print command signals and print data from a host computer, and controls a drive voltage generating circuit 161, a head drive circuit 162, and a carriage drive circuit 163 in accordance with those received signals and data, for various purposes. Through the control, the control means causes the recording head to execute a printing operation. Further, the control means determines the time to vibrate the meniscus on the basis of clock data from a print timer 164, and causes the head drive circuit 162 to output a drive signal to the piezoelectric transducers 23 to minutely vibrate the transducers at a drive frequency, a pressure variation and a time duration, which are suitable for the current circumstances, on the basis of data from a memory means 167.

The print timer 164 starts its counting operation at the start of a printing operation, and is reset at a time when minute vibration starts. A cartridge loading time detecting means 165 receives a signal from a means for detecting the loading and unloading of an ink cartridge 9 to and from a cartridge holding portion, for example, the carriage 1. The means 165 starts to operate when an ink cartridge 9 is loaded anew, and is reset when it is unloaded. A temperature sensing means 166 senses ambient temperature and head temperature.

Figure 23:
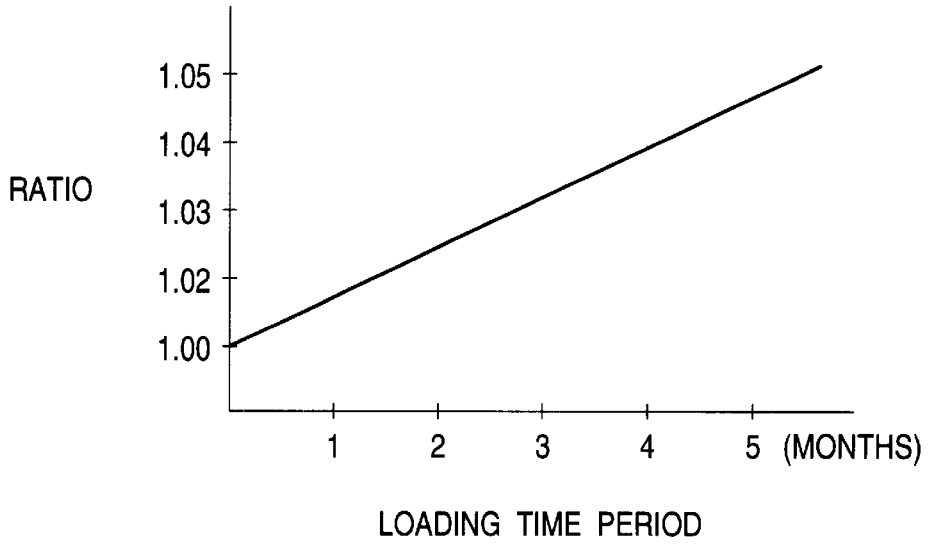
FIG. 23 is a graph showing a pressure variation, expressed in terms of relative value, in a pressure generating chamber for causing a minute vibration with respect to a loading period of an ink cartridge.
Figure 24:
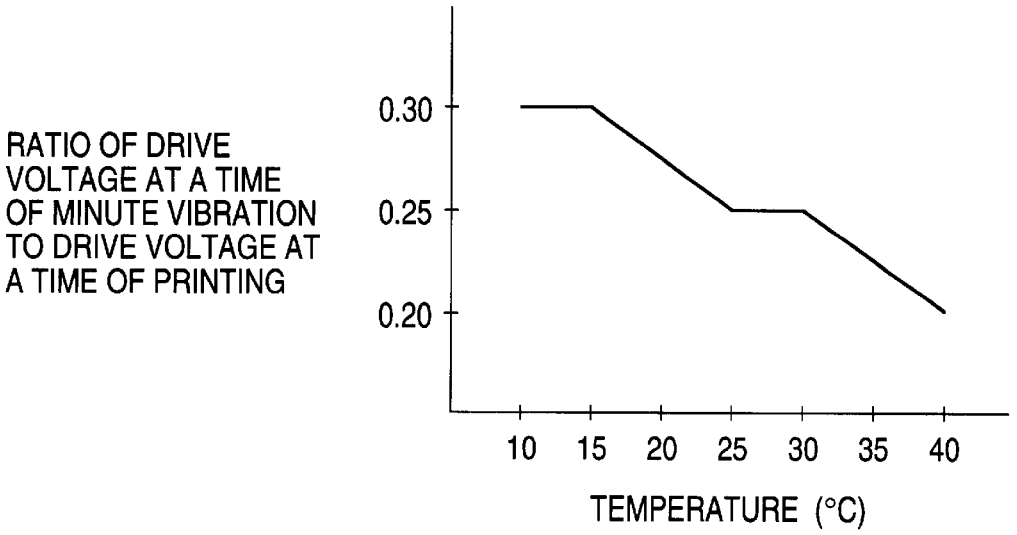
FIG. 24 is a graph showing a variation of a drive voltage, which is applied to the pressure generating means for causing a minute vibration, with respect to ambient temperature.
Figure 25:
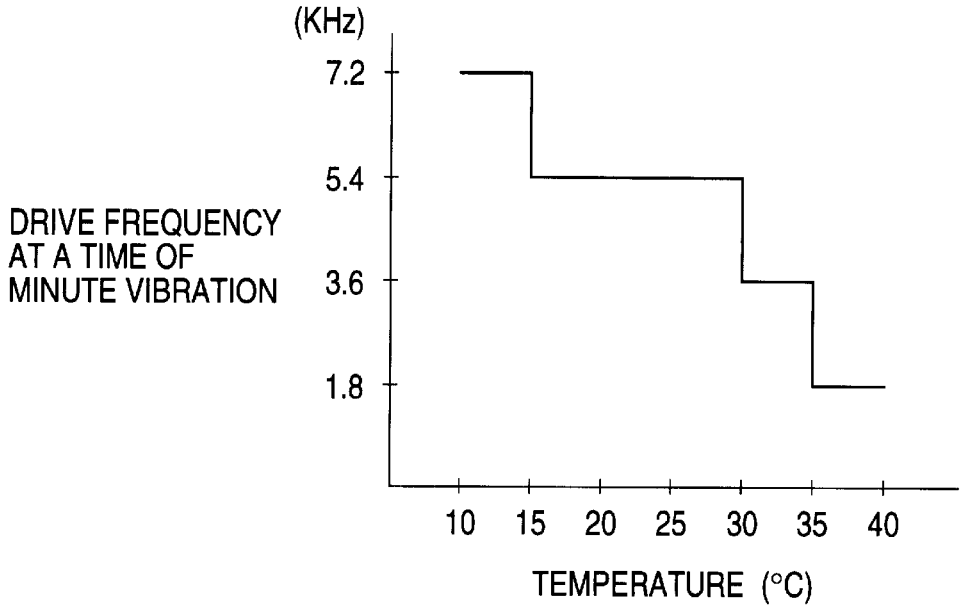
FIG. 25 is a graph showing a variation of a drive frequently at the time of minute vibration with respect to ambient temperature.

The memory means 167 stores data of ratios to increase the amplitude of a minute vibration of a meniscus in proportion to a loading time of the ink cartridge 9, for example, ratios to increase expansion quantities and contraction quantities of the pressure generating chamber 21 (FIG. 23), data to reduce a pressure variation in the pressing generating chamber 21 for causing a minute vibration as temperature becomes higher as shown in FIG. 24, and data to decrease a frequency of a drive signal for causing a minute vibration as temperature becomes higher as shown in FIG. 25.

A pressure variation in the pressure generating chamber 21 for causing a minute vibration of a meniscus may be adjusted by controlling a drive signal applied to a pressure generating means, for example, the piezoelectric transducer 23, 42, or 68. A ratio of the drive voltage at the time of minute vibration to the drive voltage at the time of printing is varied in accordance with temperature, as shown in FIG. 24, by varying an attenuation factor of a variable attenuator, for example. Specifically, the voltage ratio is set to a value that is 0.3 a the drive voltage at the time of printing in a low temperature region (10° C. to 15° C.). In a normal temperature region (15° C. to 25° C.), the voltage ratio linearly falls to a value of 0.25 times as large as the drive voltage. In a first high temperature region (25° C. to 30° C.), the voltage ratio is set to a value 0.25 times as large as the drive voltage. In a second high temperature region (30° C. to 40° C.), the voltage ratio linearly falls to a value of 0.2 times as large as the drive voltage.

A drive frequency of a minute vibration of the meniscus can readily be obtained by selecting any of the following frequencies in accordance with temperature. In the low temperature region (10° C. to 15° C.), the drive frequency is (1/integer number)×the maximum drive frequency at the time of printing)×the integer number. In this embodiment, the drive frequency is 7.2 kHs (=1/16×maximum drive frequency×16). In the normal temperature region (15° C. to 25° C.), the drive frequency is 5.4 kHz (=1/16×maximum drive frequency×12). In the first high temperature region (25° C. to 30° C.), the drive frequency is 3.6 kHz (=1/16× maximum drive frequency×8). In the second high temperature region (30° C. to 40° C.), the drive frequency is 1.8 kHz (=1/16×maximum drive frequency×4). Thus, a frequency×(1/integer) of the drive frequency at the time of printing is used as a unit frequency. The product of the unit frequency×the integer is need for the frequency of the minute vibration of the meniscus. This can be realized by using a frequency dividing circuit, not an oscillator capable of providing a plural number of frequencies for the minute vibration. In this respect, the related circuitry is simplified. Where a more complex circuit is permitted, the nozzle opening can effectively be prevented from being clogged by using a circuit capable of finely varying the amplitude values of the minute vibration and the frequency values with respect to temperature.

In the present embodiment, the control system for the recording head receives print data from a host computer, and the control means 160 recognizes a temperature of the recording head 7 from a signal derived from the temperature sensing means 166, and selects a vibration mode suitable for the minute vibration. When the temperature is higher than room temperature, the viscosity of ink decreases, and hence the meniscus tends to vibrate. Therefore, in this case, a pressure variation for causing a minute vibration is set to small value. That is, a voltage of a drive signal to be applied to the piezoelectric transducer 23 is set at a low value. Further, a frequency of a minute vibration is set to be lower than at the normal temperature. For example, in the first high temperature region (25° C. to 30° C.), 3.6 kHz (=1/16× maximum drive frequency×8) is selected for the drive frequency. In the second high temperature region (30° C. to 40° C.), 1.8 kHz (=1/16×maximum drive frequency×4) is selected. In this way, a minute vibration of the meniscus is continued while avoiding the evaporation of ink solvent and the suction of air through the nozzle openings, which arise from a high speed movement of the meniscus. Further, at high temperature, an ink viscosity is low and hence its diffusion rate is high. In this case, by reducing the number of vibrations in one cycle, evaporation of the ink solvent through the nozzle opening 24, which ensues from the minute vibration, is controlled to be small, and a viscosity of ink near the nozzle opening 24 is swiftly reduced.

Either of the following methods may be used for minutely vibrating a meniscus. A first method in which the pressure generating chamber being minutely expanded at the start of a minute vibration, and then being restored. A second method includes the pressure generating chamber being minutely contracted at the start of a minute vibration. When the first method is used, the meniscus vibrates with respect to a position where the meniscus reaches as the result of pulling the meniscus from the nozzle opening 24 side to the pressure generating chamber. Accordingly, the vibrating meniscus does not wet the nozzle plate 35 since it fails to reach the nozzle opening 24. The meniscus minutely vibrates at an amplitude high enough to diffuse the ink near the nozzle opening into the ink in the pressure generating chamber 21.

When temperature is lower than room temperature, the ink viscosity is high, so that the meniscus is hard to vibrate. Then, a pressure variation of the pressure generating chamber 21 for the minute variation is set to large value. That is, the voltage of the drive signal applied to the piezoelectric transducer 23 is set to a high value, and the drive frequency is set to be relatively high; 7.2 kHz (=1/16×maximum drive frequency×16);

Thus, even if the ambient temperature is lower than normal temperature and the ink viscosity is high, the meniscus near the nozzle opening 24 receives a higher pressure than at normal temperature. It can minutely vibrate at an amplitude suitable for preventing clogging, irrespective of the high viscosity of ink. The high viscosity ink near the nozzle opening is diffused into the ink in the pressure generating chamber, so that its viscosity is decreased. Needless to say, a lesser amount of ink solvent is allowed to evaporate because of the low temperature, and no bubbles are pulled into the nozzle opening 24 if the frequency of the minute vibration is set to a high value since the ink viscosity is high.

When the ink cartridge 3 remains loaded with ink for a long time, the amount of ink solvent evaporated from the container (i.e., the ink carriage 9) is large. Accordingly, ink in the cartridge has a high viscosity. In this case, the pressure variation for the minute vibration is preferably increased on the basis of data received—from the cartridge loading time detecting means 165, and, if necessary, the vibrating frequency of the meniscus is slightly increased. As a result, the meniscus can be minutely vibrated at the amplitude and the drive frequency that are suitable for the clogging prevention, irrespective of evaporation of ink solvent from the ink cartridge 9 and a variation of the ink viscosity caused by a variation of ambient temperature.

Thus, the recording head is free from clogging and ready for printing. A print signal is then output and a first drive signal for the discharging of ink droplets is output to the piezoelectric transducers 23. At the start of the printing, the print timer 164 starts to count and outputs a signal when the print time reaches the time for minute vibration. When the recording head reaches a point near the end of a print line and enters its deceleration phase, the control means 160 decreases the pressure for the minute vibration and the frequency of the minute vibration to be lower than at normal temperature when ambient temperature is high, as described above. On the other hand, when the ambient temperature is low, the pressure variation and the frequency of the minute vibration are increased to a value higher than at normal temperature. Further, the control means outputs a signal to vary the pressure for causing a minute vibration corresponding to a time lapse since the ink cartridge 9 is loaded. Accordingly, the meniscus is minutely vibrated at a drive frequency and a pressure, which correspond to ambient temperature and a time length since the ink cartridge 9 is loaded, when it is impossible to print.

The carriage 1 stops at a preset position while the meniscus is minutely vibrating. Then, the carriage 1 is reversed and accelerated toward the printing area along the next print lines. Immediately before the speed of the carriage 1 reaches a constant speed allowing for printing operation, the minute vibration of the meniscus is stopped. The time to minutely vibrate the meniscus for preventing clogging during the print period is retarded and set at a time point where the carriage 1 enters a deceleration phase for the return. Therefore, the meniscus can be minutely vibrated as long as possible without any interruption of the printing operation. Further, the nozzle opening can be prevented from being clogged, without any decrease of the printing speed. Additionally, the viscosity of the ink near the nozzle opening 24 will not increase when the recording head 7 is idling, which is caused by the return operation of the head.

After a predetermined amount of printing ends and a preset waiting time elapses, the recording head 7 moves to a home position, and capped and waits for the next printing operation. If required, in a waiting mode, the meniscus may be minutely vibrated at fixed time intervals for preventing an increase of ink viscosity. When the head is in the waiting mode and the meniscus is minutely vibrated, if a print command is received, the control means 160 accelerates the carriage 1 toward the printing area while keeping the minute vibration of the meniscus, stops the minute vibration immediately before the speed of the carriage reaches a constant speed, and starts the printing by the recording head.

Figure 26:
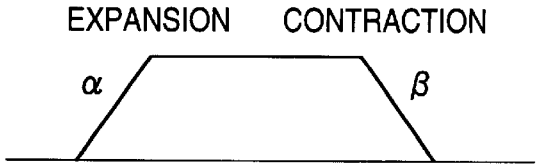
FIGS. 26(*a*) and 26(*b*) are waveform diagrams showing signals for adjusting the amplitude of a minute vibration.
Figure 26:
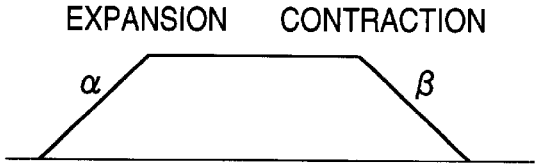
Figure 27:
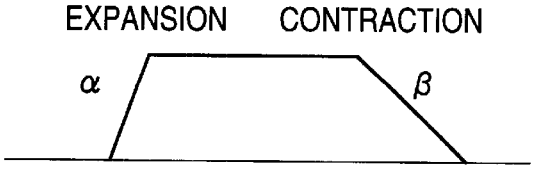
FIG. 27 is a waveform diagram showing another signal for causing a minute vibration.

In the above-mentioned embodiment, an amplitude of the minute vibration is controlled by adjusting the voltage of a drive signal applied to the piezoelectric transducer. By adjusting rates $\alpha$ and $\beta$ of voltage changes of the drive signal applied to the pressure generating chamber 21 as shown in FIG. 26, an expanding rate and a contracting rate of the pressure generating chamber 21 can be adjusted when it is minutely expanded, and hence the pressure at the time of expanding of the pressure generating chamber can be adjusted. Further, if the rate $\beta$ of voltage change when the pressure generating chamber is minutely contracted is set to a value smaller than the rate $\alpha$ of voltage change when it is minutely expanded as shown in FIG. 27, the meniscus may rapidly be pulled to the pressure generating chamber 21, to promote the diffusion of the ink near the nozzle opening 24 into the pressure generating chamber 21. When the meniscus is pushed back, dynamic energy of the meniscus is reduced, so that the meniscus may be minutely vibrated while not producing from the nozzle opening 24.

In the embodiments mentioned above, to minutely vibrate the meniscus, a drive signal is applied to the pressure generating means provided in association with the pressure generating chambers. When using a recording head in which the pressure generating means for causing a minute vibration is provided in association with the reservoir, as shown in FIG. 4, a drive signal of such as amplitude as to minutely vibrate the meniscus near the nozzle opening 24 is applied to the pressure generating means 68 of the reservoir at the timing of causing a minute vibration. The ink-jet recording apparatus of the on-carriage type in which the ink cartridge 9 is located on the carriage 1 is discussed in the above-mentioned embodiments. However, it is evident that the present invention is applicable to an ink-jet recording apparatus of the type in which the ink cartridge 9 is placed on the frame, and ink is supplied to the recording head by an ink tube.

There has thus been shown and described a novel ink-jet recording head which fulfills all the objects and advantages sought therefor. Many changes, modifications, vibrations and other uses and applications of the subject invention will, however, become apparent to those skilled in the art after considering the specification and the accompanying drawings which disclose preferred embodiments thereof. All such changes, modifications, vibrations and other uses and applications which do not depart from the spirit and scope of the invention are deemed to be covered by the invention which is limited only by the claims which follow.

What is claimed is:

1. An ink jet recording apparatus having an ink-jet recording head including pressure generating chambers each communicatively connected to a nozzle opening and a reservoir, ink stored in said pressure generating chambers and said reservoirs and forming a meniscus at each of said nozzle openings, pressure generating means for pressurizing the pressure generating chambers to eject ink droplets selectively from said nozzle openings, and means for minutely vibrating a meniscus at each of said nozzle openings to an extent insufficient to eject an ink droplet, said ink jet recording apparatus comprising:

a drive voltage generating circuit for generating a drive waveform, wherein said drive waveform contains a first drive waveform for minutely vibrating the meniscus and a second drive waveform for ejecting ink droplets during one print period; and a drive circuit selectively outputting at least one of a signal of said first drive waveform and a signal of said second drive waveform to said pressure generating means and said means for minutely vibrating the meniscus.

2. The ink jet recording apparatus according to claim 1, wherein said drive voltage generating circuit generates said first drive waveform following said second drive waveform in said drive waveform.

3. The ink jet recording apparatus according to claim 1, wherein said drive voltage generating circuit generates said second drive waveform following said first drive waveform in said drive waveform.

4. The ink jet recording apparatus according to claim 1, wherein said means for minutely vibrating the meniscus additionally vibrates the meniscus during a print rest period in such a manner that the meniscus vibrates with a greater amplitude during the print rest period than during the print period.

5. The ink jet recording apparatus according to claim 1, wherein said means for minutely vibrating the meniscus varies an amplitude of the minute vibration of the meniscus in accordance with ambient temperature.

6. The ink jet recording apparatus according to claim 5, wherein, when the ambient temperature is high, the amplitude of the minute vibration of the meniscus is smaller than that at normal temperature, and when the ambient temperature is low, the amplitude of the minute vibration of the meniscus is larger than that at normal temperature.

7. The ink jet recording apparatus according to claim 1, wherein said means for minutely vibrating the meniscus comprises said pressure generating means.

8. The ink jet recording apparatus according to claim 1, wherein said means for minutely vibrating the meniscus comprises a piezoelectric transducer.

9. The ink jet recording apparatus according to claim 1, wherein said drive circuit selectively outputs at least the signal of said second drive waveform during a first print period or the signal of said first drive waveform during a print period immediately following the first print period.

10. A method in an ink jet recording apparatus having an ink-jet recording head including pressure generating chambers each communicatively connected to a nozzle opening and a reservoir, ink stored in said pressure generating chambers and said reservoirs and forming a meniscus at each of said nozzle openings, pressure generating means for pressurizing the pressure generating chambers to eject ink droplets selectively from said nozzle openings, and means for minutely vibrating a meniscus at each of said nozzle openings to an extent insufficient to eject an ink droplet, said method comprising:

performing a first operation mode in which the meniscuses of all the nozzle openings are vibrated plural times in succession for a predetermined period of time;

placing the meniscuses in a state that said meniscuses are capable of discharging ink droplets; and applying a drive signal for discharging ink droplets to said pressure generating means.

11. The method according to claim 10, further comprising:

performing a second operation mode in which said meniscuses of all the nozzle openings are vibrated in succession for a preset period T2 at every period T1 interval when the ink jet recording apparatus is in a non-print operation.

12. The method according to claim 11, further comprising:

when said first operation mode is selected during the performance of said second operation mode, suspending said second operation mode and performing said first operation mode.

13. The method according to claim 11, wherein the minute vibration in said first operation mode is performed for a longer duration than said time duration T2 of the minute vibration in said second operation mode.

14. The method according to claim 10, further comprising:

performing a third operation mode in which the meniscuses of said nozzle opening are selectively minutely vibrated for one print period during a print period.

15. The method according to claim 14, wherein said third operation mode is performed before the discharging of the ink droplet.

16. The method according to claim 14, wherein said third operation mode is performed after the discharging of the ink droplet.

17. The method according to claim 14, wherein the meniscuses is vibrated such that an amplitude of the minute vibration of each meniscus in said first operation mode is larger than that of the minute vibration of each meniscus in said third operation mode.

18. The method according to claim 10, wherein the meniscuses is vibrated such that the meniscuses are minutely vibrated in said first operation mode, and after substantially 10 ms elapses from the minute vibration, said drive signal is applied to said pressure generating means.

19. The method according to claim 10, further comprising:

varying an amplitude of a minute vibration of the meniscus depending on ambient temperature.

20. The method according to claim 19, wherein the amplitude of the minute vibration of the meniscus is varied depending on ambient temperature in such a manner that, when ambient temperature is high, the amplitude of the minute vibration of the meniscus is smaller than that at normal temperature, and when ambient temperature is low, the amplitude of the minute vibration of the meniscus is larger than that at normal temperature.

21. The method according to claim 10, wherein the meniscuses of a plural number of groups of nozzle openings are vibrated at different times in a sequential manner.

22. The method according to claim 10, wherein the minute vibration of the meniscus is produced by said pressure generating means.

23. The method according to claim 10, wherein the minute vibration of the meniscus is produced by a piezoelectric transducer.

24. The method according to claim 10, wherein a frequency of the minute vibration of each meniscus is varied depending on ambient temperature.

25. The method according to claim 10, wherein the recording apparatus further includes a carriage carrying said ink-jet recording head thereon;

said method further comprising reciprocative moving said carriage in a direction orthogonal to a transporting direction of a recording sheet, wherein said moving comprises accelerating said carriage; and wherein the meniscuses in said first operation mode is minutely vibrated while said carriage is accelerating to reach such a speed as to allow a printing operation.

26. The method according to claim 25, further comprising:

performing a second operation mode in which said meniscuses of all the nozzle openings are vibrated in succession for a preset period T2 at every period T1 interval, the time period T1 being shorter that the sum of the preset period T2 and a time period T5 required for said carriage with said ink-jet recording head mounted thereon to move at a printing speed in a printable region.

27. The method according to claim 25, wherein the meniscuses are vibrated in succession as in said first operation mode when said carriage with said ink-jet recording head mounted thereon, which is being moved at a constant speed, is decelerated.

28. The method according to claim 25, further comprising:

wherein detecting a time point of starting the minute vibration of the meniscuses as in said first operation mode, said time point being continued from a time point at which the deceleration of said carriage with said ink-jet recording head mounted thereon starts; and when the deceleration period is shorter than said time period T2, stopping the minute vibration of the meniscuses.

29. The method according to claim 25, wherein the minute vibration in said first operation mode or the minute vibration as in said first operation mode is performed at an instant that an acceleration or a deceleration of said carriage with said ink-jet recording head mounted thereon starts.

30. The method according to claim 25, wherein the minute vibration of the meniscuses in said first operation mode is started at an instant that said carriage with said ink-jet recording head mounted thereon comes to a standstill.

31. The method according to claim 10, wherein a drive signal for causing the vibration that has a charging gradient of 5 to 50% of that of a drive signal for discharging the ink droplet is utilized in said first operation mode.

32. A method in an ink jet recording apparatus having an ink-jet recording head including a pressure generating chambers each communicatively connected to a nozzle opening and a reservoir, ink stored in said pressure generating chamber and said reservoirs and forming a meniscus at each of said nozzle openings, said method comprising:

pressurizing the pressure generating chambers to eject ink droplets selectively from said nozzle openings;

minutely vibrating a meniscus at each of said nozzle openings to an extent insufficient to eject an ink droplet; and vibrating said meniscuses present at the nozzle openings in succession for a preset period T2 at every period T1 interval when the ink jet recording apparatus is in a non-print operation.

33. The method according to claim 32, wherein the meniscuses are minutely vibrated at fixed periods T1 after a rest period that is longer than said fixed period T2.

34. The method according to claim 33, further comprising wherein setting an amplitude of the minute vibration during a print period to be smaller than that of the meniscus during a print rest period.

35. The method according to claim 32, wherein, during each print period ink droplets are caused to eject through said nozzle and/or the meniscuses are caused to selectively minutely vibrate.

36. The method according to claim 32, further comprising varying an amplitude of a minute vibration of the meniscus depending on ambient temperature.

37. The method according to claim 32, further comprising:

varying an amplitude of a minute vibration of the meniscus depending on ambient temperature in such a manner that when ambient temperature is high, an amplitude of a minute vibration of the meniscus is smaller than that at normal temperature, and when ambient temperature is low, the amplitude of a minute vibration of the meniscus is larger than that at normal temperature.

38. The method according to claim 32, wherein the meniscuses of a plural number of groups of nozzle openings are vibrated at different times in a sequential manner.

39. The method according to claim 32, wherein the minute vibration of the meniscus is produced by a pressure generating means.

40. The method according to claim 32, wherein the minute vibration of the meniscus is produced by a piezoelectric transducer.

41. The method according to claim 32, further comprising:

varying a frequency of the minute vibration of each meniscus depending on ambient temperature.

* * * * *